US006749092B2

(12) United States Patent
Olechowski et al.

(10) Patent No.: US 6,749,092 B2
(45) Date of Patent: Jun. 15, 2004

(54) DEFORMABLE DISPENSING VALVE

(75) Inventors: Gregory M. Olechowski, Midland, MI (US); Timothy R. Socier, Essexville, MI (US); John M. Hess, III, Midland, MI (US); James P. Manning, Chagrin Falls, MI (US); Stuart R. Brown, Midland, MI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 0 days.

(21) Appl. No.: 10/122,579

(22) Filed: Apr. 15, 2002

(65) Prior Publication Data

US 2003/0029890 A1 Feb. 13, 2003

Related U.S. Application Data

(63) Continuation-in-part of application No. 09/928,113, filed on Aug. 10, 2001, now abandoned.

(51) Int. Cl.[7] ..... B67D 3/00; B67D 5/06; B65D 25/40

(52) U.S. Cl. ..... 222/514; 222/525; 222/498; 222/490; 222/493; 222/494

(58) Field of Search ..... 222/525, 514, 222/498, 490, 491, 493, 518, 494

(56) References Cited

U.S. PATENT DOCUMENTS

| | | | | |
|---|---|---|---|---|
| 2,758,755 A | * | 8/1956 | Schafler | 222/212 |
| 3,221,952 A | | 12/1965 | De See | |
| 3,321,114 A | | 5/1967 | Croyle | |
| 4,141,474 A | * | 2/1979 | Nilson | 222/493 |
| 4,141,475 A | * | 2/1979 | Nilson | 222/494 |
| 4,506,809 A | | 3/1985 | Corsette | |
| 4,699,300 A | * | 10/1987 | Blake | 222/494 |
| 5,503,282 A | * | 4/1996 | Montgomery | 215/252 |
| 6,062,435 A | | 5/2000 | Hess, III | |
| 6,095,382 A | | 8/2000 | Gross | |
| 6,223,956 B1 | * | 5/2001 | Albers | 222/494 |
| 6,273,305 B1 | * | 8/2001 | Fioravanti et al. | 222/494 |
| 6,293,437 B1 | * | 9/2001 | Socier et al. | 222/212 |

OTHER PUBLICATIONS

International Search Report for PCT/US02/23371.

U.S. patent application Ser. No. 09/928,113.

* cited by examiner

*Primary Examiner*—Kevin Shaver
*Assistant Examiner*—Stephenie L. Willatt
(74) *Attorney, Agent, or Firm*—Wood, Phillips, Katz, Clark & Mortimer

(57) ABSTRACT

A valve system is provided with a wall portion that includes an inlet side, an outlet side, at least one aperture extending between the inlet and outlet sides, and a valve seat on the outlet side. One preferred form of the valve system also includes a movable valve member having a spout, a mounting portion, a toggle portion, and at least one seal surface for sealingly engaging the wall portion valve seat when the valve member is toggled to a closed position to prevent flow from the wall portion aperture through the spout.

8 Claims, 20 Drawing Sheets

DEFORMABLE DISPENSING VALVE

CROSS REFERENCE TO RELATED APPLICATION(S)

This application is a continuation-in-part of application Ser. No. 09/928,113, filed Aug. 10, 2001, now abandoned.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a product from a container. This invention is more particularly related to a system incorporating a valve system which is especially suitable for use with a container from which a substance can be discharged from the container through the valve system.

BACKGROUND OF THE INVENTION AND TECHNICAL PROBLEMS POSED BY THE PRIOR ART

A variety of packages, including dispensing packages or containers, have been developed for dispensing beverages, fluent food products, personal care products such as shampoo, lotion, etc., as well as other materials. Such containers typically have an open upper end on which is mounted a dispensing closure.

One type of dispensing closure for these kinds of containers has a flexible, pressure-openable, self-sealing, slit-type dispensing valve mounted in the closure over the container opening. The term "pressure-openable' refers to a valve which opens when a sufficient pressure differential is applied across the valve (e.g., as by increasing the pressure on one side and/or decreasing the pressure on the side). When the container is squeezed, the valve slits open, and the fluid contents of the container are discharged through the open slits of the valve. The valve automatically closes to shut off fluid flow therethrough upon removal of the increased pressure—even if the container is inverted so that the closed valve is subjected to the weight of the contents within the container.

Designs of closures using such valves are illustrated in the U.S. Pat. Nos. 5,271,531 and 5,033,655. Typically, the closure includes a body mounted on the container to hold the valve over the container opening. A lid can be provided for engaging the closure body to cover the valve during shipping and when the container is otherwise not in use. See, for example, FIGS. 31–34 of U.S. Pat. No. 5,271,531. Such a lid can be designed to prevent leakage from the valve under certain conditions. The lid can also keep dust and dirt from the valve and/or can protect the valve from damage.

The inventors of the present invention have determined that it would be advantageous to provide a new type of valve system or dispensing structure that can provide certain operational advantages. It would be particularly beneficial to provide such a new type of valve system or dispensing structure with the capability for being opened by the user without necessarily requiring the user to squeeze or pressurize the container.

It would also be desirable to provide such an improved system with the capability for being opened merely by the user pulling on the structure with the lips or teeth of the user. This would permit, for example, the user to hold the package or container in one hand without requiring the user to manipulate the dispensing structure or valve system with the other hand in order to open and close it.

Such an improved valve system could also have the capability for allowing the user to apply a continuous force to hold the valve system partially open as well as for allowing the valve system to be maintained in a full open configuration without requiring the user to continuously hold it open or continuously maintain a dispensing pressure in the container. The dispensing system should preferably also be readily closed by application of a relatively briefly applied, low force.

It would also be desirable to provide an improved dispensing valve system that could dispense product at a relatively high flow rate compared to conventional closures of similar size.

It would also be beneficial if such an improved dispensing valve system could optionally accommodate the employment of an ancillary lid or frangible, tamper-evident cover or tear band.

Further, it would be beneficial if such an improved dispensing valve system could optionally accommodate the addition or inclusion of another (i.e., second) valving structure in the form of a pressure-openable, flexible, slit valve.

An improved dispensing valve system should also accommodate designs which permit incorporation of the system as a unitary part, or extension, of the container as well as designs that separately mount the dispensing system on the container in a removable or non-removable manner.

It would also be beneficial if such an improved dispensing valve system could readily accommodate its manufacture from a variety of different materials.

Further, it would be desirable if such an improved dispensing valve system could be provided with a design that would accommodate efficient, high-quality, large volume manufacturing techniques with a reduced product reject rate.

Preferably, the improved dispensing valve system should also accommodate high-speed manufacturing techniques that produce products having consistent operating characteristics unit-to-unit with high reliability.

The present invention provides an improved dispensing valve system which can accommodate designs having the above-discussed benefits and features.

SUMMARY OF THE INVENTION

According to one aspect of the present invention, a dispensing valve system is provided for discharging fluent contents from the interior of a container. The valve system includes a wall portion that can be incorporated on the container. The wall portion includes an inlet side and an outlet side. There is at least one aperture extending between the inlet and the outlet sides. A valve seat is located on the outlet side of the wall portion.

The valve system further includes a valve member. The valve member includes (1) a mounting portion for being fixed relative to the container, (2) a spout that defines a dispensing passage terminating in a dispensing orifice, and (3) a resiliently deformable portion extending between the mounting portion of the valve member and the spout to accommodate movement of the valve member from a self-maintained closed position to at least a partially open position. For example, in one form of the invention, the valve system may be temporarily held in a partially open, or full open, configuration when the valve member is subjected to a continuously applied force of sufficient magnitude—typically by the user pulling outwardly on the valve member (and/or by the user squeezing the container (to which the valve system is attached) with enough force to create an internal pressure sufficient to open the valve system). In another form of the invention, the valve system is designed so that when it is moved to a full open configuration, it will remain open even after the user lets go of the valve system and/or reduces the container internal pressure.

In the preferred form of the invention, the resiliently deformable portion is a toggle portion extending between the mounting portion and the spout. The toggle portion provides the further advantageous capability or feature of the valve member in either the self-maintained closed position or a self-maintained open position, namely, the user does not have to apply a continuous force to keep the system closed or open.

Finally, the valve member includes at least one seal surface recessed inwardly from the spout dispensing orifice for sealingly engaging the wall portion valve seat when the valve member is in the closed position so as to prevent flow from the wall portion aperture through the spout dispensing passage.

In one preferred form of the invention, the valve system is part of a closure assembly or unitary closure structure. The closure assembly is adapted for mounting to a container which has an opening to the container interior. The closure assembly has a housing or body for (a) retaining the valve system therein, and (b) being mounted on the container at the container opening so as to position the valve system over the container opening.

In another preferred form of the invention, the valve system includes a valve member which is a unitary part of a molded closure body extending from a container. The closure body may be a unitary part of the container or may be a separate component adapted to be permanently or releasably attached to the container. Where the valve member is a unitary molded portion of the closure body, such a valve member can be characterized as including a mounting portion for being fixed relative to the container wherein the mounting portion is a portion of the closure body. The valve member of such a unitary closure body also includes a spout that defines a dispensing passage terminating in a dispensing orifice. The valve member of such a unitary closure body also includes a resiliently deformable portion extending between the mounting portion and the spout for holding the valve member in a self-maintained closed position and accommodating movement to an open position. The valve member also has at least one seal surface recessed inwardly from the spout dispensing orifice for sealingly engaging a wall portion that can be incorporated on a container or in the closure body. In the preferred embodiments, the wall portion is provided either as a separate component mounted in the closure body or as a unitary molded portion of the closure body. The wall portion includes (1) an inlet side and an outlet side, (2) at least one aperture extending between the inlet and outlet sides, and (3) a valve seat on the outlet side. The seal surface on the valve member is adapted to sealingly engage the wall portion valve seat when the valve member is in the closed position to prevent flow from the wall portion aperture through the spout dispensing passage.

Optionally, a removable lid may be frangibly connected over the valve system.

Further, an optional, flexible, pressure-openable slit valve may be disposed in, or molded as a unitary part of, the spout across the dispensing passage.

The valve system of the present invention readily accommodates movement between open and closed positions. Such movement may be effected by the user grasping the spout between a thumb and index finger, and then pulling the spout outwardly. Alternatively, the user may grasp the spout between the user's teeth or lips, and then pull the spout outwardly to the open configuration. In some embodiments, where the toggle force to open the valve is not great, the user could also pressurize the system, as by squeezing a flexible container on which the valve system is mounted, so as to force the valve member to a partially open, or full open, configuration.

When the valve system is in the self-maintained full open configuration with the spout outwardly disposed, the valve member may be readily toggled back into the closed configuration by briefly applying a relatively small force to the spout. The force may be applied substantially inwardly along a line of action parallel to the length of the spout, or the force may be applied obliquely to the spout. The application of such a force to the spout causes the resiliently deformable toggle portion to snap back into the self-maintained closed position to hold the valve system closed.

In an alternate embodiment, a travel stop is incorporated in the system to prevent the valve member from moving all the way to the self-maintained, fully open position. The user must maintain a continuous outward force on the valve member to hold it in a deformed, partially open position to prevent it from closing. Such a mode of operation could be effected even without the employment of a travel stop in the system.

The valve system of the present invention need not necessarily be operated to dispense product through the toggled, self-maintained, full open configuration. In some instances it may be sufficient, and desirable, to merely partially open the valve system to dispense a small quantity of product. To this end, the user can push or pull the valve member spout sideways to a tilted configuration or straight out just a small amount—but not to a toggled, self-maintained, full open configuration—to cause the valve member to move away from at least a portion of the valve seat. Under such a mode of operation, the user must maintain a force on the spout continuously to hold the valve in the tilted configuration (or pulled straight out a small amount) so that at least a partial flow path is created under an unseated portion of the valve member. As soon as the user releases the force on the spout, the valve member assumes its normal, generally vertical, closed configuration so as to prevent further flow. Indeed, in some applications where it is desired to operate a valve system with a continuous biasing force on the valve member to maintain an open flow path, it would not be necessary that the valve member have a full opening toggle action providing a self-maintained open position. The valve member need only provide a self-maintained closed position which can accommodate opening under the influence of a continuously applied force to hold the valve member in a partially open configuration. This can simplify the structure of the valve member since the need to have a bi-stable, toggle action mode of operation is not required.

Numerous other advantages and features of the present invention will become readily apparent from the following detailed description of the invention, from the claims, and from the accompanying drawing.

BRIEF DESCRIPTION OF THE DRAWINGS

In the accompanying drawings that form part of the specification, and in which like numerals are employed to designate like parts throughout the same.

DESCRIPTION OF THE PREFERRED EMBODIMENTS

Figure 1:
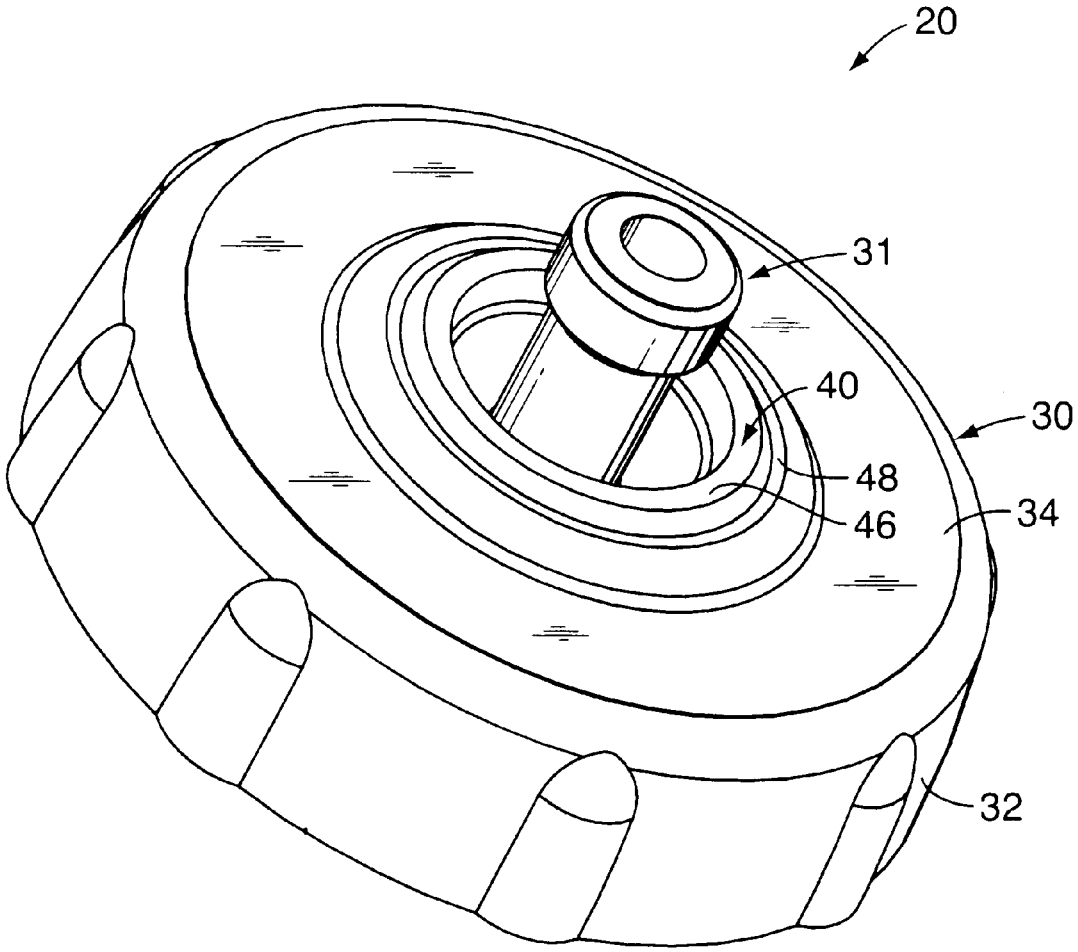
FIG. 1 is a perspective view of a first embodiment of the dispensing valve system of the present invention in a preferred form comprising a separate closure assembly that is shown in a self-maintained, closed configuration and that is adapted to be mounted on a container.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing valve system of this invention is described in one, generally upright orientation. It will be understood, however, that the dispensing valve system of this invention may be manufactured, stored, transported, used, and sold in orientations other than the position described.

One presently preferred embodiment of the dispensing valve system of the present invention is illustrated in FIGS. 1–5 in the form of a dispensing closure assembly designated generally by the reference number 20. The dispensing closure assembly 20, which is hereinafter sometimes referred to more simply as the "closure 20," is provided as a separately manufactured unit or subassembly for mounting to the top of a container (not shown). It will be appreciated, however, that it is contemplated that in some applications it may be desirable for the dispensing valve system 20 to be formed as a unitary part, or extension, of the container.

The container typically has a conventional mouth which provides access to the container interior and product contained therein. The product may be, for example, a beverage such as water, or other liquid comestible product. The product could also be any other fluent material, including, but not limited to, powders, particles, and liquids (including creams, lotions, slurries, pastes, etc.). Such materials may be sold, for example, as a food product, a personal care product, an industrial or household product, or other composition (e.g., for internal or external use by humans or animals, or for use in activities involving medicine, manufacturing, commercial or household maintenance, construction, agriculture, etc.).

The container may typically have a neck or other suitable structure defining the container mouth. The neck may have (but need not have) a circular cross-sectional configuration, and the body of the container may have another cross-sectional configuration, such as an oval cross-sectional shape, for example. The container may, on the other hand, have a substantially uniform shape along its entire length or height without any neck portion of reduced size or different cross-section.

The container may typically be a squeezable container having a flexible wall or walls which can be grasped by the user and compressed to increase the internal pressure within the container so as to squeeze the product out of the container through the closure 20 when the closure 20 is open. Such a container wall typically has sufficient, inherent resiliency so that when the squeezing forces are removed, the container wall returns to its normal, unstressed shape.

Such a structure is preferred in many applications, but may not be necessary or preferred in other applications. Indeed, the container may be substantially rigid. A piston could be provided in such a rigid container to aid in dispensing a product, especially a relatively viscous product. On the other hand, a rigid container could be employed for inverted dispensing of the contents solely under the influence of gravity and/or under the influence of a reduced ambient pressure exterior of the container (e.g., as by sucking on the open closure 20).

Figure 4:
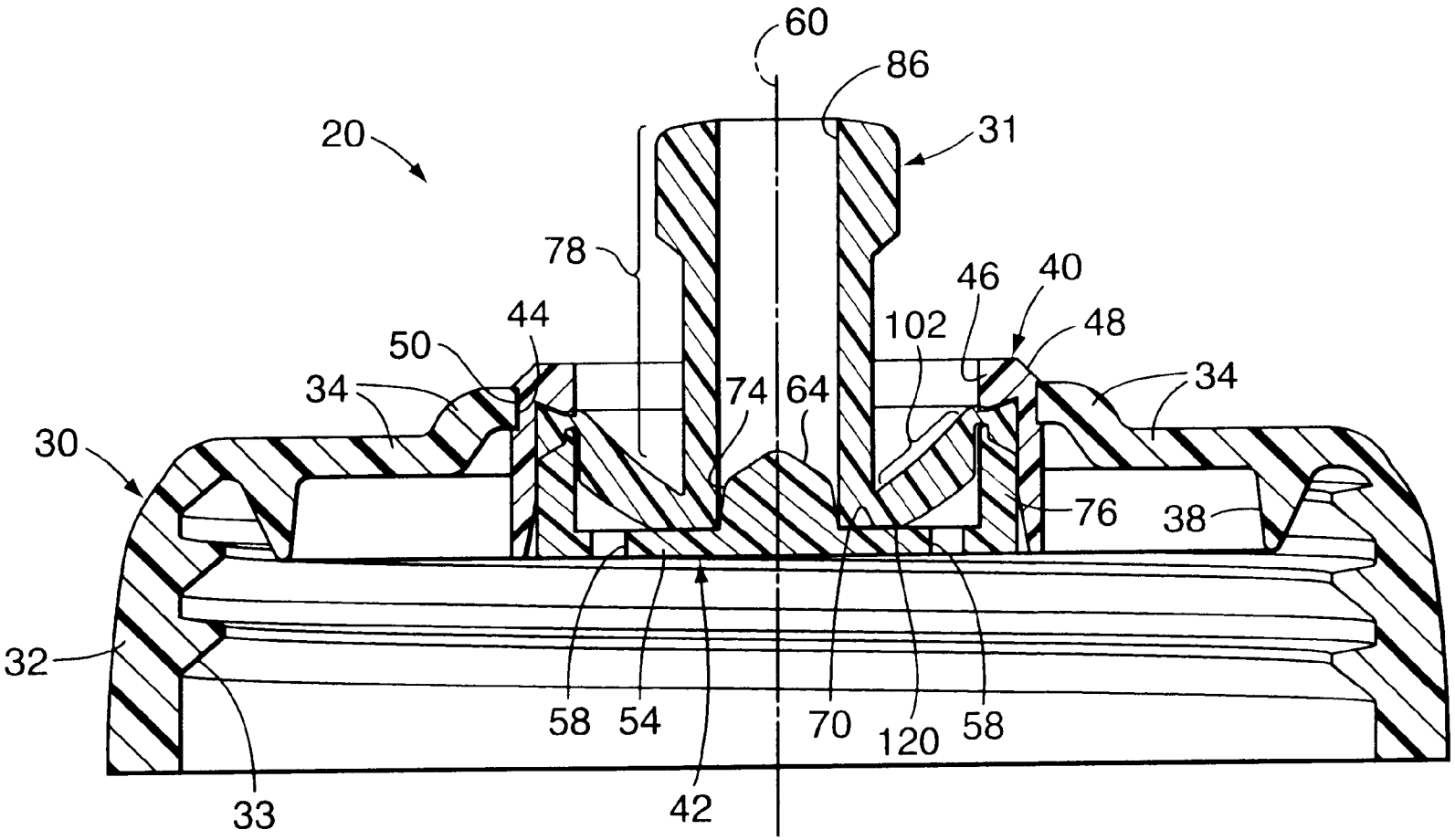
FIG. 4 is a cross-sectional view taken generally along the plane 4—4 in FIG. 3.

The closure 20 includes a housing or body 30 and a movable valve member 31 (FIG. 4). The closure housing or body 30 defines a skirt 32 (FIG. 4) which has a conventional thread 33 for engaging a mating container thread (not shown) to secure the closure body 30 to the container (not shown).

The closure body 30 and container could also be releasably connected with a snap-fit bead and groove, or by other means. Alternatively, the closure body 30 may be permanently attached to the container by means of induction melting, ultrasonic melting, gluing, or the like, depending upon the materials employed for the container and closure body 30. Further, the closure 20 could, in some applications, be formed as a unitary part, or extension, of the container.

At the top of the closure skirt 32, the closure body 30 defines a radially inwardly extending, annular deck 34 (FIGS. 1 and 4). Preferably, as can be seen in FIG. 4, an annular seal 38 projects from the lower surface of the closure body deck 34 and is designed to provide a leak-tight seal between the closure body 30 and the inner periphery of the container opening. Of course, other conventional or non-conventional types of closure body/container seals may be employed.

As shown in FIG. 4, the valve member 31 is retained within the closure body 30 by means of an outer retaining ring 40 and an inner retaining ring 42. The inner retaining ring 42 is held by a friction fit in the outer retaining ring 40. A snap-fit bead and groove arrangement (not illustrated) could be employed instead, or some other suitable attachment system could be used.

The outer retaining ring 40 and inner retaining ring 42 clamp a portion of the valve member 31 and secure it within the closure body 30. To this end, the closure body deck 34 defines an opening 44 (FIG. 4) for receiving the subassembly of the outer retaining ring 40, inner retaining ring 42, and valve member 31.

As illustrated in FIGS. 1 and 4, the outer retaining ring 40 has a generally annular configuration with an inwardly extending flange or shoulder 46 having a peripheral, angled or chamfered surface 48 for accommodating pushing of the ring 40 into the closure body aperture 44 from the inside or underside of the closure body 30. The exterior of the outer retaining ring 40 defines a shallow, annular groove or channel 50 as shown in FIG. 4 for accommodating the inner, peripheral edge of the closure body deck 34 at the closure body deck opening 44. The peripheral edge of the closure body deck 34 at the opening 44 is sufficiently resilient to snap-fit into the shallow groove 50 in the outer periphery of the outer retaining ring 40. Typically, a subassembly consisting of the valve member 31, outer retaining ring 40, and inner retaining ring 42, in an already assembled condition, would be inserted together into the closure body opening 44 so as to properly effect a snap-fit engagement between the closure body deck 34 and the outer retaining ring 40.

Figure 2:
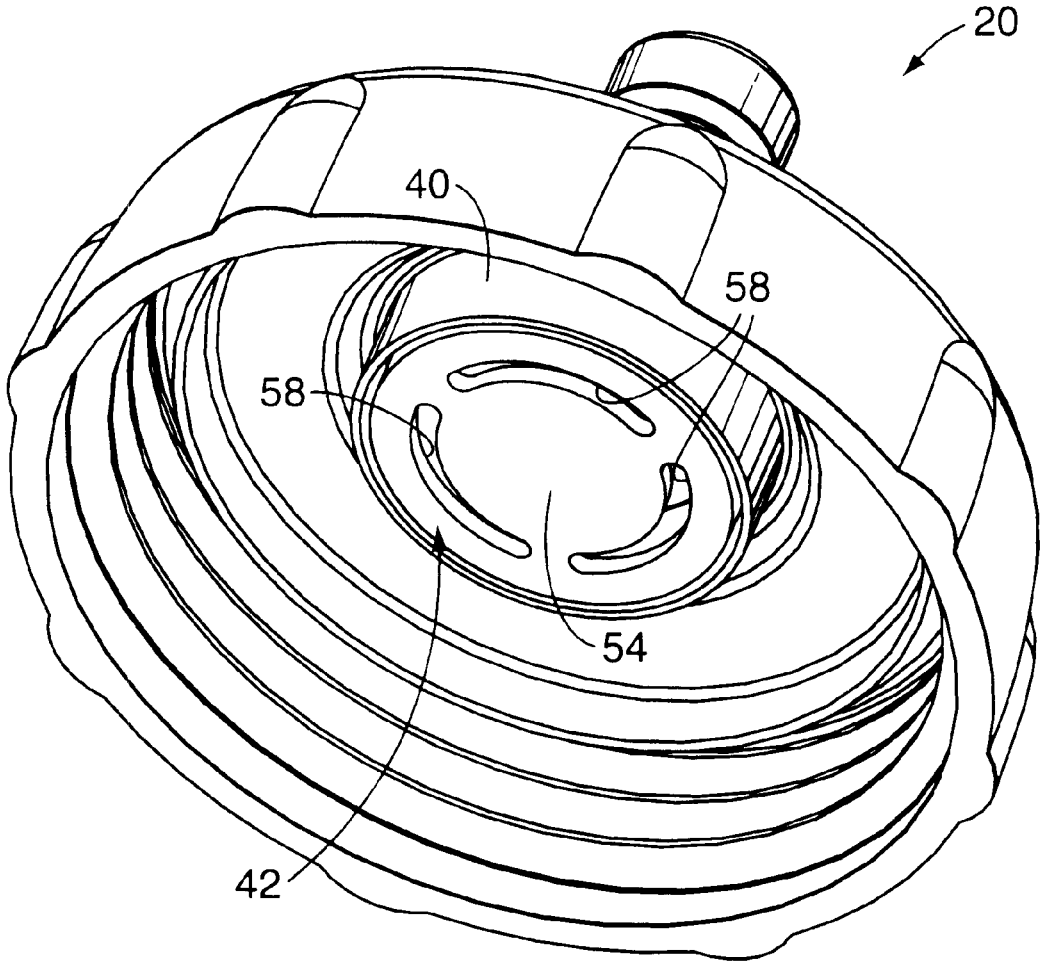
FIG. 2 is a perspective view of the bottom of the first embodiment of the closure assembly.
Figure 3:
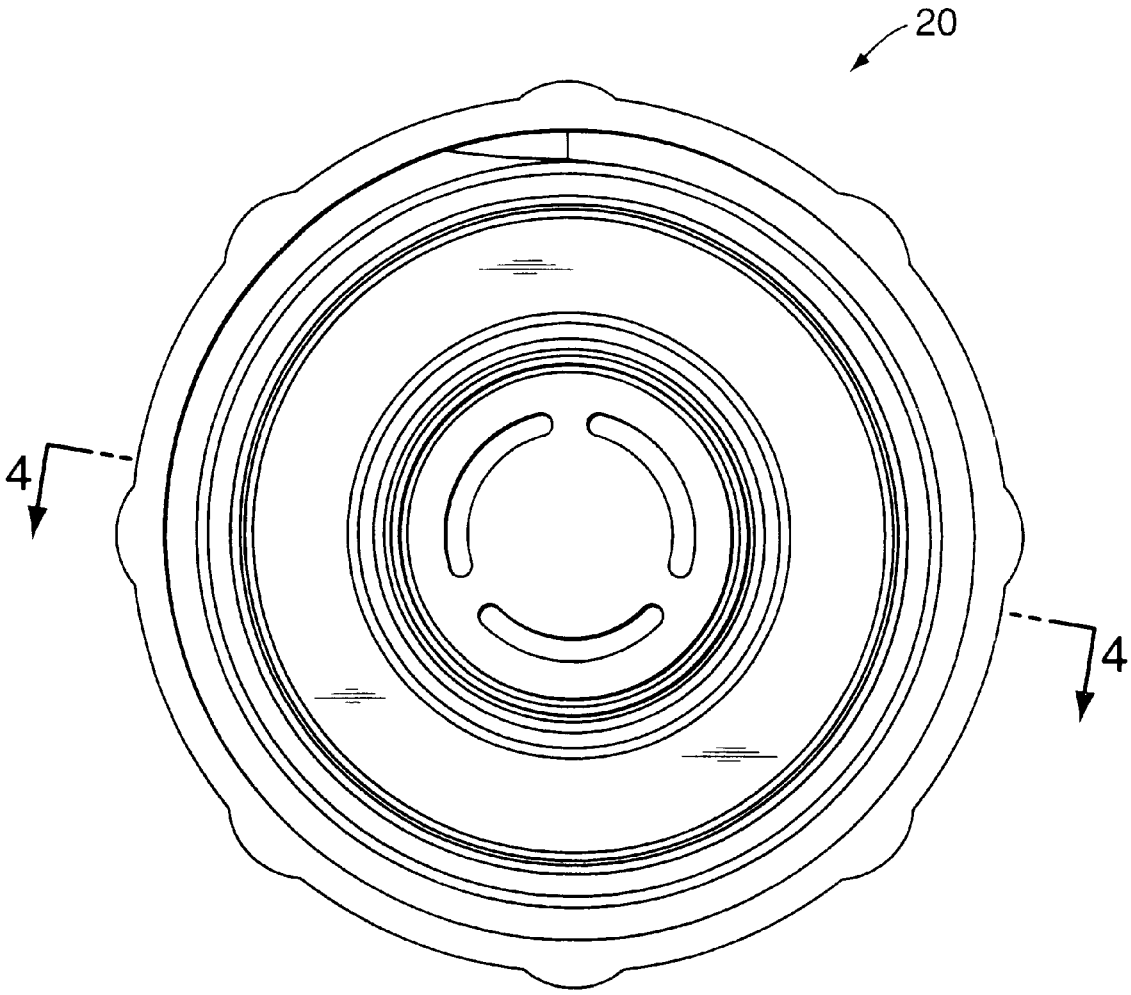
FIG. 3 is a bottom plan view of the first embodiment of the closure assembly shown in FIGS. 1 and 2.

As can be seen in FIG. 2, the preferred embodiment of the inner retaining ring 42 has a generally circular configuration which includes at least a circular deck or wall portion 54. The circular wall portion 54 defines at least one aperture 58. In the preferred embodiment illustrated in FIG. 2, there are three apertures 58, and each aperture 58 is an arcuate slot having a locus which is a circular arc. As can be seen in FIG. 2, the three, circular arc slots or apertures 58 are arranged equidistantly and symmetrically about an axial centerline 60 (FIG. 4) through the closure 20.

With reference to FIG. 4, the inner retaining member 42 may be characterized as having an inlet side and an outlet side wherein the inlet side faces downwardly toward the container on which the closure 20 is mounted. The outlet side faces upwardly or outwardly from the container. Each of the apertures 58 extends from the inlet side to the outlet side of the wall portion 54.

As can be seen in FIG. 4, the wall portion 54 of the inner retaining ring 42 has a central region that includes a central projection 64 which extends upwardly from the outlet side of the wall portion 54. Each aperture 58 may be characterized as being located radially outwardly of the projection 64.

Figure 5:
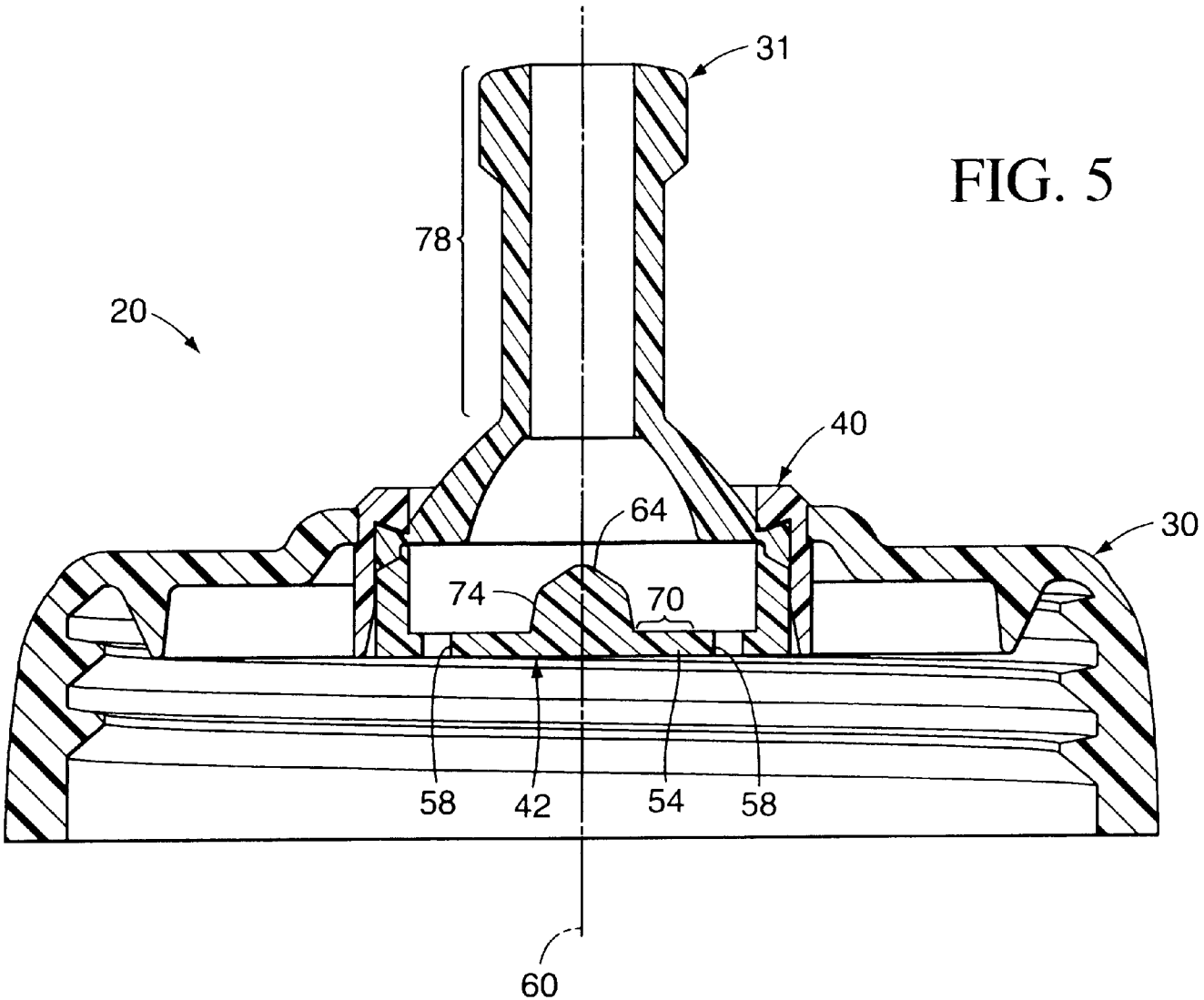
FIG. 5 is a view similar to FIG. 4, but FIG. 5 shows the closure assembly in the self-maintained open position.

With reference to FIG. 5, the outlet side of the inner retaining ring wall portion 54 defines a sealing surface or valve seat 70. In the preferred embodiment illustrated in FIG. 5, the valve seat 70 is a generally flat, annular portion of the upper or outer surface on the outlet side of the inner retaining ring wall portion 54.

In a preferred form of the invention, the inner retaining ring central projection 64 has a frustoconical portion defining a tapered surface 74 as shown in FIG. 5. The tapered surface 74 may optionally serve to help align the valve member 31 in the closed condition (FIG. 4) and help augment the sealing of the valve member 31 when it is in the closed position. The tapered surface 74 may then be characterized as also defining a part of the valve seat 70 such that the valve seat 70 includes both the annular tapered surface and the surrounding, annular flat surface.

With reference to FIG. 4, it can be seen that at the periphery of the inner retaining ring wall portion 54 there is an outwardly projecting flange 76 which is adapted to engage a portion of the valve member 31 and, together with the outer retaining ring 40, clamp the valve member 31 in position. An exterior surface portion of the inner retaining ring flange 76 preferably has an outside diameter slightly larger than the adjacent surface of the outer retaining ring 40 so that the inner retaining ring 42 can be held by a frictional engagement within the outer retaining ring 40.

Optionally, a snap-fit bead and groove engagement may be provided wherein the outer surface of the inner retaining ring flange 76 includes a circumferential bead (not shown), and the inner surface of the outer retaining ring 40 includes a mating circumferential groove (not shown) for receiving the bead.

Alternatively, the snap-fit bead could be provided on the inner surface of the outer retaining ring 40, and a mating groove could be provided on the outer surface of the inner retaining ring flange 76.

In still another alternative, two snap-fit engagement beads could be provided—one on the outer surface of the inner retaining ring flange 76 and one on the inner surface of the outer retaining ring 40.

Other means of attaching the outer retaining ring 40 to inner retaining ring 42 may be provided, and such other means could be releasable or non-releasable. Indeed, the outer retaining ring 40 and inner retaining ring 42 could be secured together with mechanical staking, thermobonding, adhesive bonding, etc.

In a preferred embodiment, the closure body 30, outer retaining ring 40, and inner retaining ring 42 are each separate components molded from an appropriate thermoplastic material, such as polyethylene or polypropylene. When the closure body 30 is installed on a container (not illustrated) with the valve member 31 held in place by the outer retaining ring 40 and inner retaining ring 42, the wall portion 54 of the inner retaining ring 42 may be characterized as a "wall" or "wall portion" of the system for containing the fluent material within the container on the inlet side of the closure 20. It will be appreciated that the wall portion 54 need not be part of the inner retaining ring 42 per se. Instead, the inner retaining ring 42 could be omitted altogether, and the closure body 30 could be molded in the form of a continuous, unitary structure which would include the wall portion 54 and apertures 58 therein. In another alternative, rather than provide a separate closure body 30 for releasably or removably mounting to a container, the container could instead be made with an integral or unitary wall portion, such as the wall portion 54 having one or more apertures 58, and the valve member 31 could then be mounted adjacent the wall portion 54 by suitable means.

Figure 6:
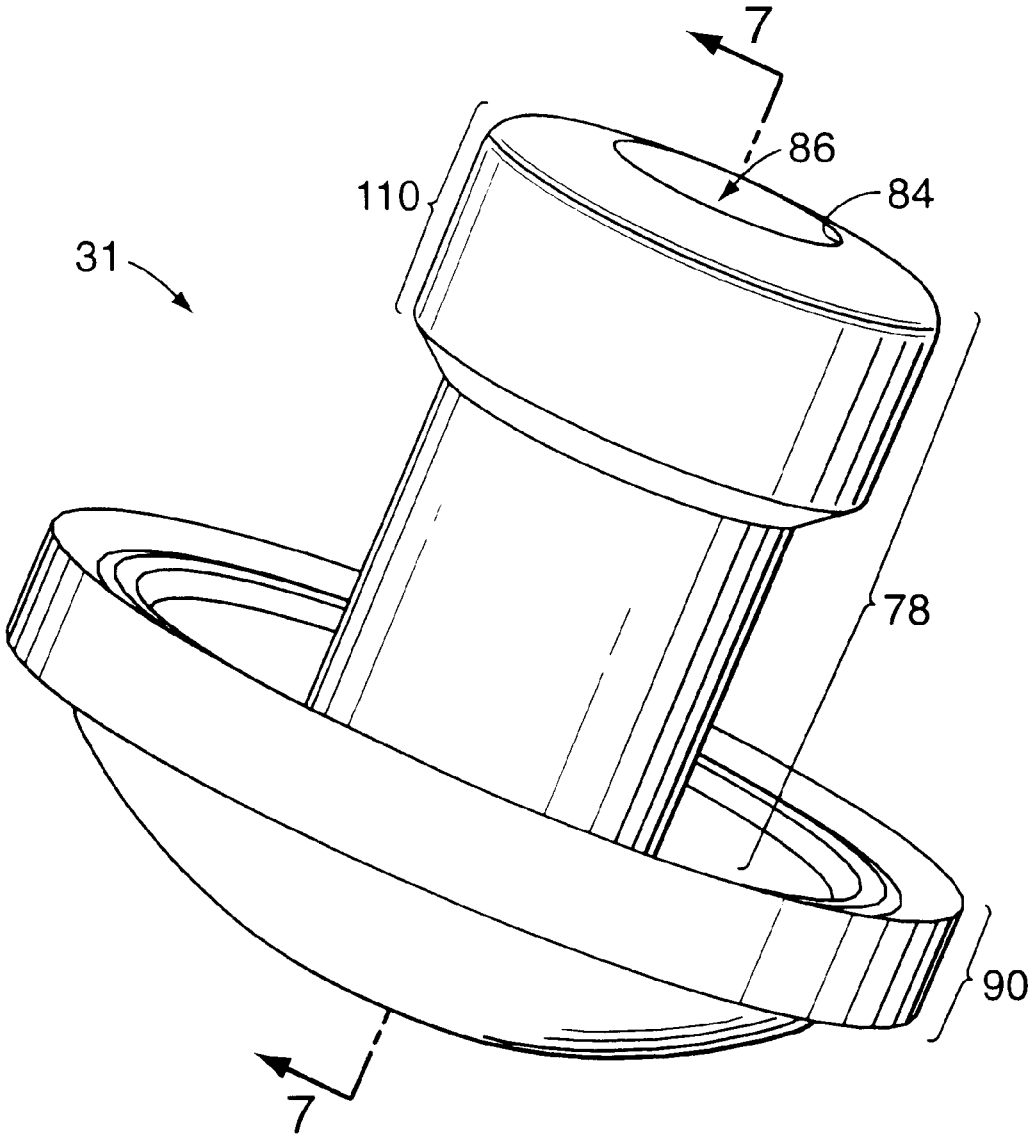
FIG. 6 is an enlarged, perspective view of the valve member of the present invention removed from the closure assembly illustrated in FIGS. 1–5.
Figure 7:
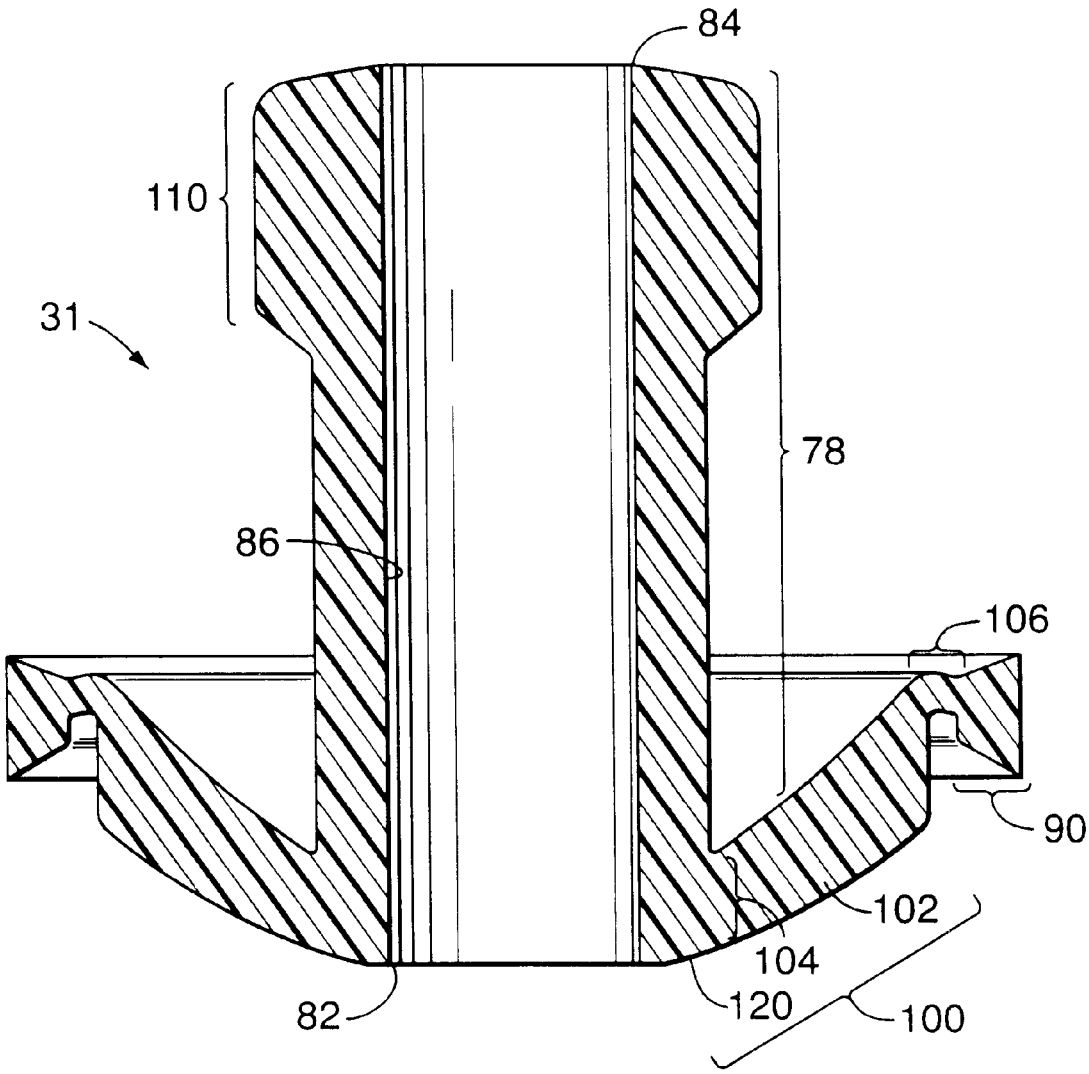
FIG. 7 is a cross-sectional view taken generally along the plane 7—7 in FIG. 6.
Figure 8:
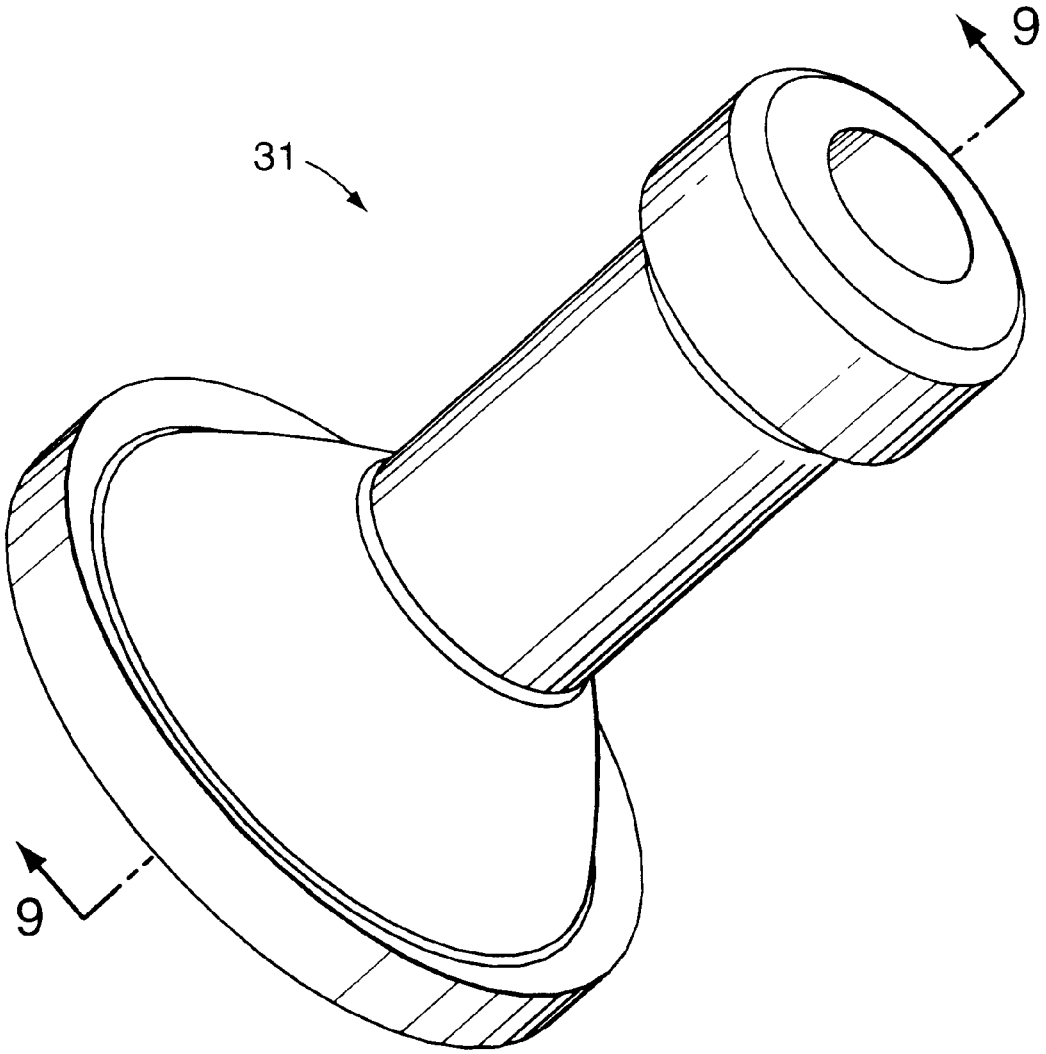
FIG. 8 is a perspective view similar to FIG. 6, but FIG. 8 shows the valve member in a self-maintained open configuration.

The valve member 31 is a movable valve member, and in the preferred form, the valve member 31 is a bistable valve member that is movable between a self-maintained closed position (FIG. 4) and a self-maintained open position (FIG. 5). With reference to FIG. 6, the valve member 31 includes an outwardly projecting spout 78. With reference to FIG. 7, the spout 78 has an inlet opening 82, an outlet opening or dispensing orifice 84, and a dispensing passage 86 which extends between the inlet opening 82 and the dispensing orifice 84.

With reference to FIG. 7, the valve member 31 includes a peripheral mounting portion 90. In the preferred embodiment illustrated, the mounting portion 90 is the generally annular flange having a generally dovetail cross-sectional configuration for being clamped between mating angled surfaces of the outer retaining ring flange 46 and inner retaining ring flange 76 as shown in FIG. 4. This fixes the position of the mounting portion 90 of the valve member 31 relative to the container on which the closure 20 is mounted.

The valve member 31 could also be attached to the closure 20 by swaging, ultrasonic welding, or by other releasable or non-releasable means of conventional or non-conventional design.

With reference to FIG. 7, the valve member 31 includes a deformable portion 100 extending between the mounting portion 90 and the spout 78. In the preferred form of the invention, the deformable portion 100 is a toggle portion 100 that includes (a) a resiliently deformable, generally annular member 102, (b) a first hinge region 104 between the generally annular member 102 and the spout 78, and (c) a second hinge region 106 between the generally annular member 102 and the mounting portion 90.

The upper, outer, distal end of the spout 31 is preferably provided with an enlarged diameter portion 110 as illustrated in FIGS. 6 and 7. The enlarged portion 110 may be more readily grasped by a user between the user's thumb and index finger, between a user's lips, or between the teeth of a user. If the user desires to suck fluent material out of the spout 78, then the user's lips may more readily seal around the larger diameter portion 110.

With reference to FIG. 7, the bottom of the valve member 31 defines a downwardly facing seal surface 120. When the valve member 31 is in the closed configuration as illustrated in FIG. 4, the downwardly facing seal surface 120 sealingly engages the annular valve seat 70 on the upper, outlet side of the inner retaining ring wall portion 54. Additionally, a portion of the peripheral interior surface of the spout dispensing passage 86 may engage part of the central projection surface 74 to provide additional sealing engagement and/or alignment of the spout 78 in the closed position. However, the present invention contemplates designs in which the central projection 64 may be omitted along with whatever additional alignment function and sealing function such a projection may provide in cooperation with the spout 78.

When the valve member 31 is in the closed configuration as illustrated in FIG. 4, the generally annular member seal surface 120 sealingly engages the inner retaining ring outlet side annular valve seat 70 at a location between the inner retaining ring apertures 58 and the spout dispensing passage 86. This prevents flow from the container (to which the closure 30 is attached) through the spout dispensing passage 86.

The valve member 31 is preferably molded from an elastomer, such as a synthetic thermosetting polymer, including silicone rubber, such as the silicone rubber sold by Dow Corning Corp. in the United States of America under the trade designation DC 94-595HC. However, the valve member 31 can also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

Owing to the unique configuration of the valve member 31, the valve member 31 normally remains in the closed configuration shown in FIG. 4 to sealingly engage the inner retaining member wall portion 54. This is a "self-maintained," closed position. If a sufficient outward force is applied to the valve member 31, the valve member 31 can be moved to a self-maintained open position (FIG. 5). The movement of the valve member 31 from the closed position (FIG. 4) to the open position (FIG. 5) involves a "toggle action." The first hinge region 104 (FIG. 7) and the second hinge region 106 (FIG. 7) accommodate resilient deformation of the generally annular, resiliently deformable member 102 through an unstable condition of maximum stress between initial and final stable conditions of lower stress. The lower stress, initial and final stable conditions correspond to the closed and open configurations, or vice versa, of the valve member 31. Owing to the self-biasing nature of the valve member 31, it snaps from one stable position through its range of motion to the other stable position (i.e., from the closed position to the open position, or from the open position to the closed position) with a toggle-like movement.

The valve member 31 can be moved to the open position (FIG. 5) by applying sufficiently large pressure to the underside of the annular member 102 (FIG. 4) when the valve member 31 is in the closed configuration. The increased pressure forces the valve member 31 upwardly to the open position (FIG. 5). The increased pressure can be achieved by pressurizing the container to which the closure 20 is mounted. Typically, the container would have a flexible wall which can be squeezed inwardly by the user to increase the pressure within the container. This can be done while holding the container (with the closure mounted thereon) in an inverted orientation so that the fluent material within the container is squeezed and pressurized against the closed valve member 31. As the pressure moves the valve member 31 to the open position illustrated in FIG. 5, the fluent material flows from the apertures 58 and through the open valve member 31.

If desired, the user could open the valve member 31 by pulling outwardly on the valve member instead of squeezing the container to force the valve member outwardly. The user could pull the valve member 31 outwardly by grasping the end of the spout 78 between a thumb and index finger.

Alternatively, the user could grasp the end of the spout 78 between the user's teeth or lips. If the closure 20 is employed on a container of a beverage, it may be desirable and most efficient for the user to pull the valve member 31 outwardly with the user's teeth or lips and then, in the same motion, begin inverting the container and closure for dispensing the fluent material into the user's mouth. This dispensing process may be assisted by the user squeezing on the container (if it is squeezable container) and/or by the user sucking on the spout 78.

In some applications, the valve system of the present invention may be installed in an initially inverted position on a larger, stationary or portable tank or other reservoir for dispensing fluent material, such as a liquid. In such an installation, the user would place a cup or other receiving receptacle under the inverted valve system, and then the user would pull the valve spout 78 downwardly toward the cup to open the valve member 31 for dispensing flow into the cup.

The present invention contemplates that the valve member 31 need not necessarily be permitted to move all the way to the self-maintained, fully opened position (FIG. 5). Rather, in some applications, it may be desirable to prevent the valve member 31 from moving beyond the position of maximum stress at a partially opened configuration by providing an appropriate travel stop located at about the mid point or "over-center toggle point" of the system. Such a travel stop could consist of, for example, the outer retaining ring flange 46 extending further radially inwardly than is shown in FIG. 4 so that the extended flange 46 would overlie the deformable, annular member 102 and prevent the annular member 102 from moving upwardly beyond that point to the full open configuration illustrated in FIG. 5. If such a travel stop was employed, the user would have to maintain a continual outward force on the spout 78, as by continually pulling outwardly on the spout 78, in order to keep the valve member 31 open and in order to prevent the valve member 31 from snapping back to the closed position shown in FIG. 4. Thus, although the present invention contemplates that the valve member 31 include a resiliently deformable toggle portion which is at least capable of holding the valve member 31 in a self-maintained closed position and a self-maintained open position, the valve member 31 need not necessarily be mounted in a structure that actually permits movement of the valve member 31 to the self-maintained, fully open position.

The valve system of the present invention may accommodate dispensing of various fluent products, including liquids, gases, powders, particulates, etc. The flow area and length of the spout 78 can be designed, in part, to facilitate the dispensing of such a variety of products.

After the desired quantity of fluent material has been dispensed through the spout 78, the spout 78 may be returned from the fully open position (FIG. 5) to the fully closed position (FIG. 4). This may be done by pushing inwardly on the end of the spout 78 with sufficient force and for a sufficient length of travel that the valve member 31 toggles inwardly and snaps closed. However, with reference to FIG. 5, it is not necessary that a force be applied to the end of the spout 78 along a line of action substantially coincident with, or parallel to, the axis 60. Rather, the force applied to the spout 78 may be applied in an offset manner and directed at an oblique angle relative to the axis 60. Indeed, with an appropriate design, a sufficient amount of force applied substantially generally laterally to the spout 70 could be enough to cause the valve member 31 to snap or toggle inwardly to the fully closed position (FIG. 4).

Figure 9:
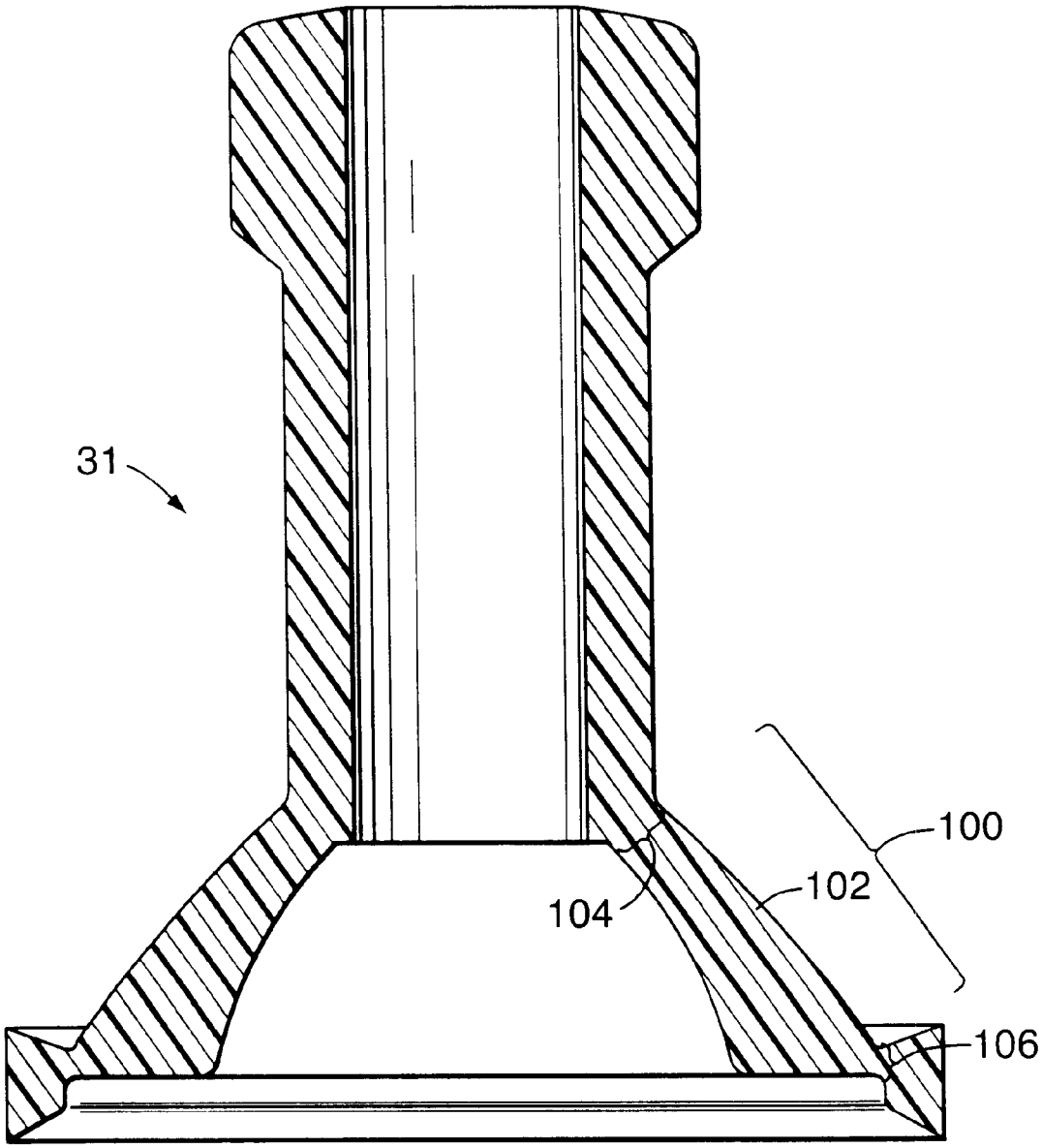
FIG. 9 is a cross-sectional view taken generally along the plane 9—9 in FIG. 8.

The force with which the valve member 31 opens and closes, and the self-maintained biasing force with which the valve member stays either open or closed, can be adjusted by appropriate design of, among other things, the width or diameter of the deformable member 102 (FIG. 9), the thickness of the first hinge region 104, the thickness of the second hinge region 106, and the particular material from which the structure is made.

The valve member 31 may be a separately molded (or otherwise manufactured) component as illustrated, or the valve member 31 may be bi-injection molded into an appropriate closure or wall portion of a container. Bi-injection molding processes, in general, are disclosed in U.S. Pat. No. 6,112,951, the disclosures of which are incorporated herein by reference thereto to the extent not inconsistent herewith. The valve member 31 could also be molded as a unitary part of the closure body 30 (i.e., as an extension of the closure body deck 34), and one such embodiment is described in detail hereinafter with reference to FIG. 13 et seq.

The valve system of the present invention need not necessarily be operated to dispense product through the toggled, self-maintained, full open configuration. In some instances it may be sufficient, and desirable, to merely partially open the valve system to dispense a small quantity of product. To this end, the user can push or pull the valve member spout 78 sideways to a tilted configuration or straight out just a small amount—but not to a toggled, self-maintained, full open configuration—to cause the valve member 31 to move away from at least a portion of the valve seat 70. Under such a mode of operation, the user must maintain a force on the spout 78 continuously to hold the valve in the tilted configuration or straight out just a small amount so that at least a partial flow path is created under an unseated portion of the valve member 31. As soon as the user releases the force on the spout 78, the valve member 31 assumes its normal, generally vertical, closed configuration as illustrated in FIG. 4 so as to prevent further flow. Indeed, in some applications where it is desired to operate a valve system with a continuous biasing force on the valve member to maintain an open flow path, it would not be necessary that the valve member have a full opening toggle action providing a self-maintained open position. The valve member need only provide a self-maintained closed position which can accommodate opening under the influence of a continuously applied force to hold the valve member in a partially open configuration. This can simplify the structure of the valve member since the need to have a bistable, toggle action mode of operation is not required.

Figure 10:
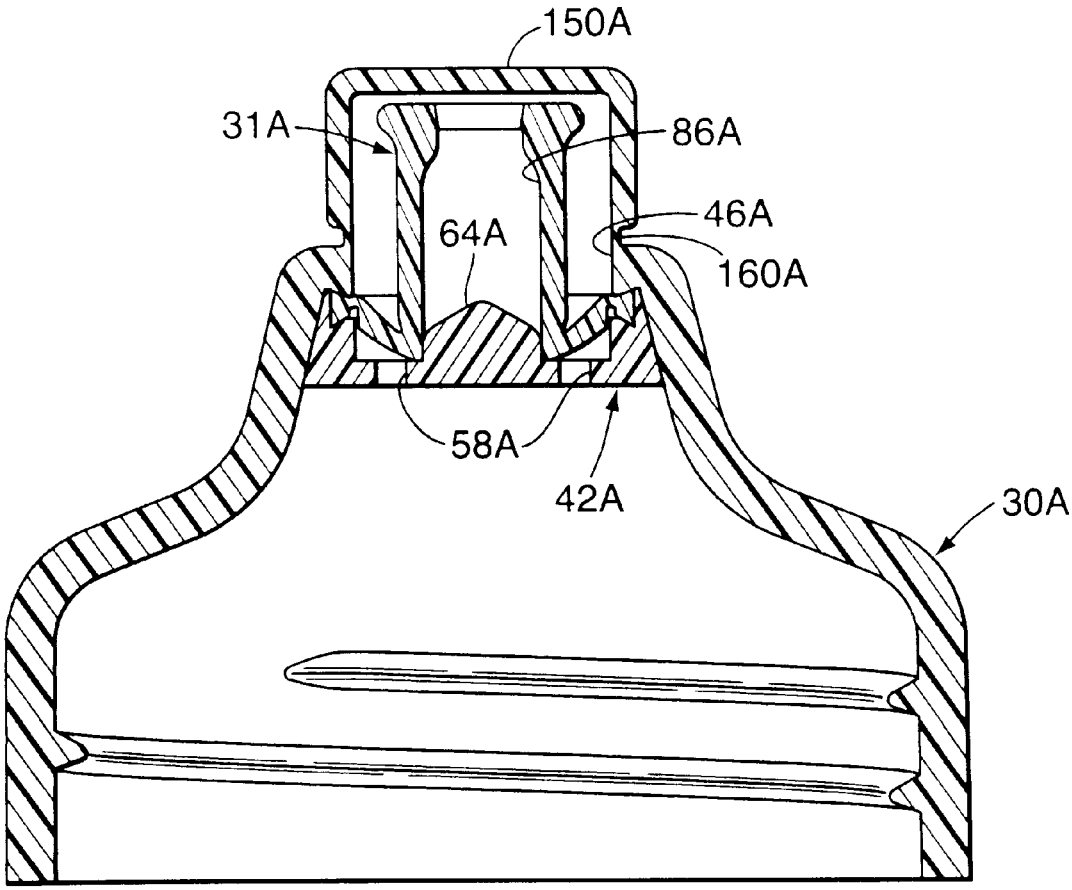
FIG. 10 is a cross-sectional view similar to FIG. 4, but FIG. 10 shows a second embodiment of a closure assembly in a closed configuration with an intact, tamper-evident cover.

FIG. 10 illustrates a second embodiment of the valve system of the present invention wherein the valve system is designated generally by the reference number 20A. The valve system 20A includes a closure body 30A in which is mounted an inner retaining ring 42A and a valve member 31A. In this embodiment, a separate outer retaining ring (such as the outer retaining ring 40 of the first embodiment shown in FIG. 4) has been omitted and replaced by an inwardly extending flange portion 46A of the closure body 30A.

The inner retaining ring 42A has a wall portion that (1) is analogous to wall portion 54 in the first embodiment illustrated in FIG. 4, and (2) includes one or more apertures 58A adjacent a projection 64A which extends upwardly into a spout dispensing passage 86A which is defined by the valve member 31A. The valve member 31A may have substantially the same configuration as the valve member 31 of the first embodiment described above with reference to FIGS. 1–9.

The upper end of the closure body 30A includes a unitary molded, frangible, cover or lid 150A. The cover 150A is joined to the rest of the closure body 30A at a reduced thickness section of material defining an annular, frangible web 160A. The user may be grasp the cover 150A and pull or twist the cover 150A relative to the closure body 30A so as to separate the cover 150A along the frangible web 160A from the closure body 30A to thereby gain access to the valve member 31A.

The valve member 31A may be manipulated between the closed position (illustrated in FIG. 10) and a fully open position (not shown) in a manner analogous to what has been described with respect to the operation of the first embodiment valve member 31 discussed above with reference to FIGS. 1–9.

In the second embodiment illustrated in FIG. 10, the apertures 58A are located somewhat radially inwardly compared to the apertures 58 of the first embodiment illustrated in FIG. 5. The valve member 31A defines a seal surface along its bottom edge at the inlet to the dispensing passage 86A, and that seal surface engages the exterior surface of the projection 64A to prevent flow of fluent material from the container through the apertures 58A and out of the dispensing passage 86A when the valve member 31A is in the closed position. In this second embodiment, the "seal surface" can be characterized as an inner, peripheral edge portion of the valve member 31A, and the valve seat can be characterized as including at least a peripheral surface portion of the projection 64A.

It will be appreciated that the second embodiment of the valve system illustrated in FIG. 10 may be further modified to include an appropriate tamper-evident system along, or at, the bottom of closure body 30A. Such a tamper-evident system could include a molded ring connected with frangible bridges to the bottom of the skirt of the closure body 30A, and the ring could have a turned in flange for engaging a cooperating flange on the exterior of the neck of a container on which the closure body is mounted. Such a tamper-evident system could be employed with the other embodiments disclosed herein.

Figure 11:
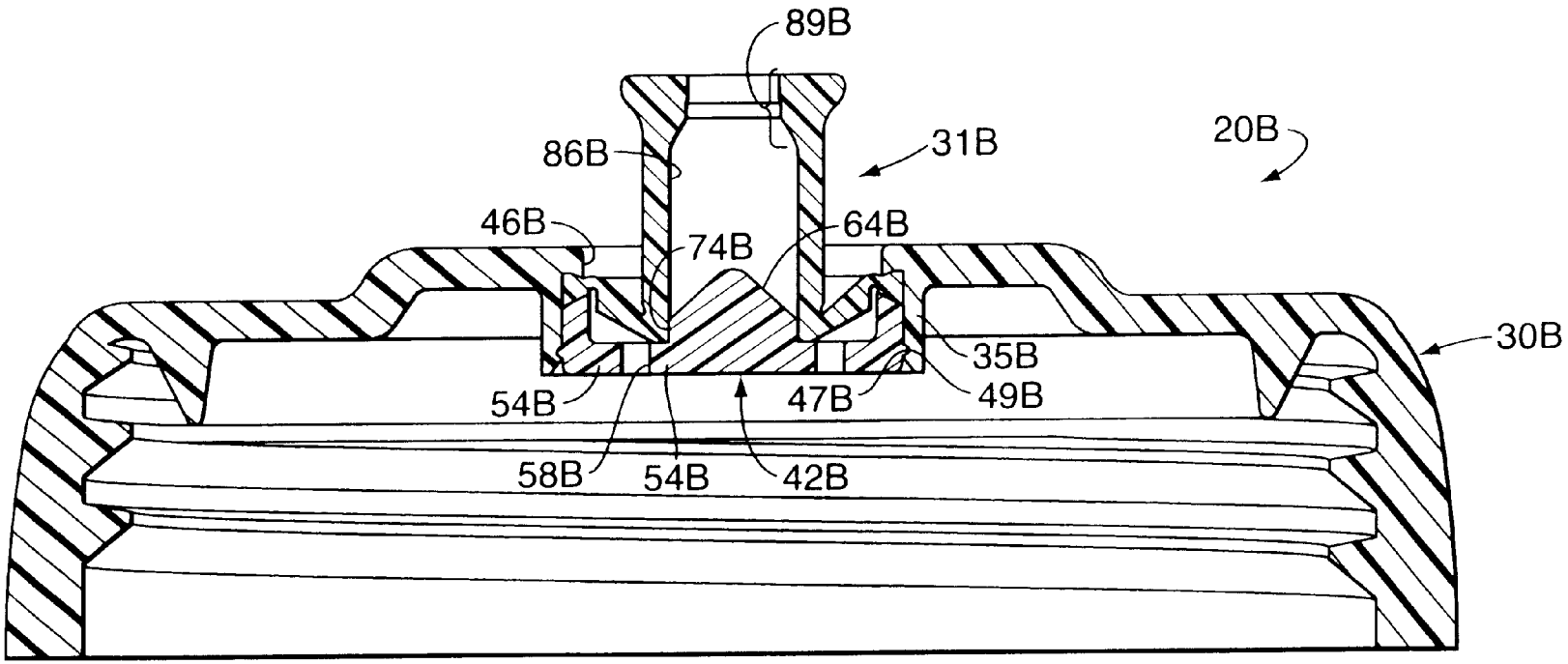
FIG. 11 is a cross-sectional view similar to FIG. 4, but FIG. 11 shows a third embodiment of a closure assembly in a closed configuration.

FIG. 11 illustrates a third embodiment of the valve system of the present invention wherein the valve system is designated generally by the reference number 20B. The valve system 20B includes a closure body 30B in which is mounted an inner retaining ring 42B. The body 30B and ring 42B together define a housing for holding a valve member 31B. In this embodiment, a separate outer retaining ring (such as the outer retaining ring 40 in the first embodiment shown in FIG. 4) has been omitted and replaced by an inwardly extending flange portion 46B of the closure body 30B.

The body 30B has a downwardly depending flange 35B defining an annular groove 47B. The inner retaining ring 42B defines an annular bead 49B for being received in a snap-fit engagement with the groove 47B of the body flange portion 35B.

The inner retaining ring 42B includes a projection 64B which has a generally cylindrical, lower portion 74B. The inner retaining ring 42B also includes one or more apertures 58B radially outwardly of the central projection 64B.

The valve member 31B is similar in shape to the valve member 31 described above with reference to the first embodiment illustrated in FIG. 4, and the valve member 31B operates in substantially the same manner as does the first embodiment valve member 31. The valve member 31B differs somewhat, however, in that it includes a reduced diameter outlet region 89B at the distal end of a dispensing passage 86B. When the third embodiment valve member 31B is in the lowered, closed position (as illustrated in FIG. 11), the inner cylindrical surface of the valve member 31B is guided and received around, and is in an adjacent relationship with, the inner retaining ring cylindrical portion 74B as shown in FIG. 11. The inner retaining ring apertures 58B are radially outwardly of the region which is sealed closed by the valve member 31B when the valve member 31B is in the closed configuration. The inner retaining ring 42B may be characterized as having (1) a wall portion 54B with inlet and outlet sides between which the apertures 58B extend, and (2) a valve seat on the outlet side against which the valve member 31B seals when the valve member 31B is in the closed configuration.

Except as noted above, each of the various portions of the third embodiment valve system 20B has substantially the same structure, and operate in substantially the same way, as do the corresponding portions of the first embodiment of the valve system 20 described above with reference to FIGS. 1–9.

Figure 12:
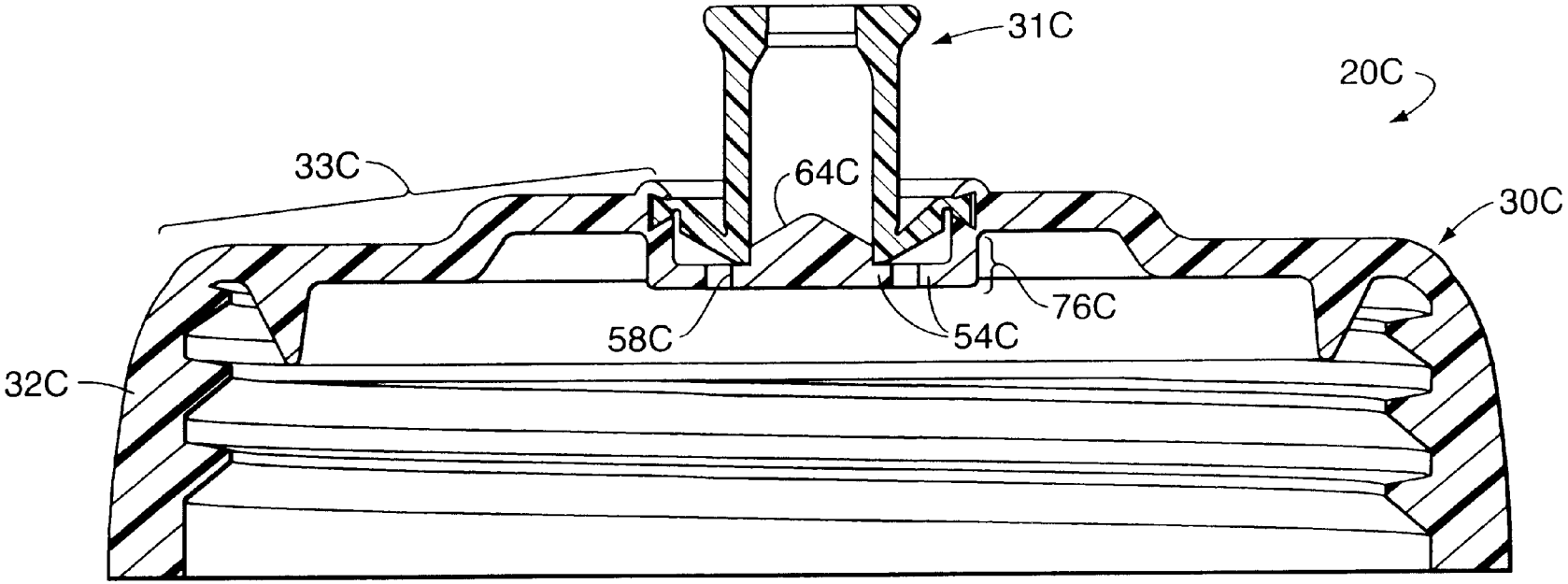
FIG. 12 is a cross-sectional view similar to FIG. 4, but FIG. 12 shows a fourth embodiment of a closure assembly in a closed configuration.

FIG. 12 illustrates a fourth embodiment of the valve system of the present invention wherein the valve system is designated generally by the reference number 20C. The valve system 20C includes a housing in the form of a closure body 30C in which is mounted a valve member 31C. The housing or body 30C includes a top wall 33C and a peripheral skirt 32C depending from the top wall 33C.

The body 30C may be characterized as a housing which is a unitary molded body that has a top wall 33C from which the skirt 32C depends. The body 30C also includes a wall portion 54C which is joined to the body top wall 33C by means of a unitary, peripheral flange 76C. The wall portion 54C defines one or more apertures 58C which are spaced outwardly of a projection 64C extending upwardly into the valve member 31C when the valve member 31C is in the closed configuration as illustrated in FIG. 12. The structure of the projection 64C and of the valve member 31C is substantially identical with the structure of the projection 64B and valve member 31B, respectively, described above with reference to the third embodiment valve system 20B illustrated in FIG. 11. The fourth embodiment valve member 31C operates in substantially the same manner as does the third embodiment valve member 31B described above.

Figure 13:
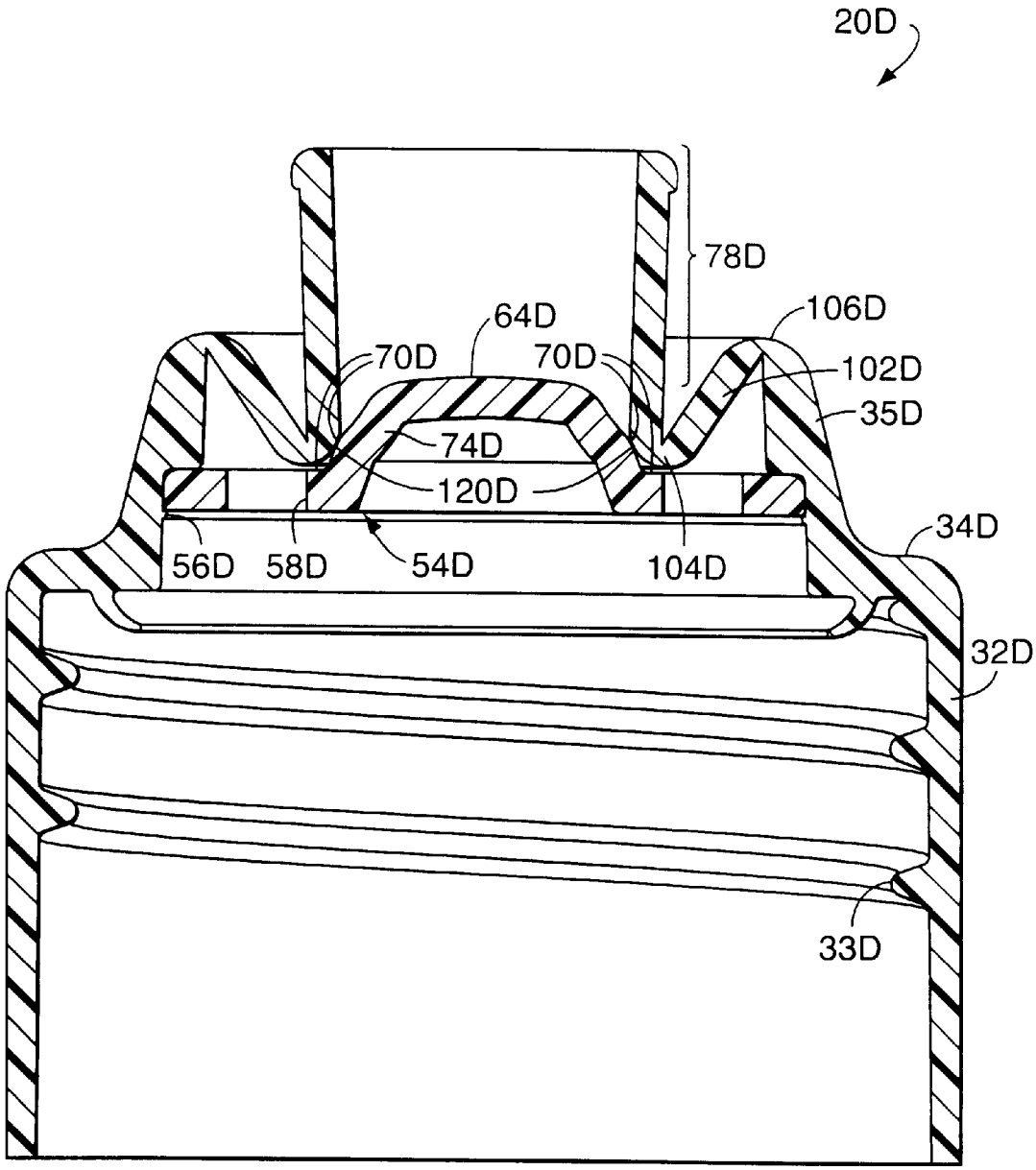
FIG. 13 is a cross-sectional view similar to FIG. 4, but FIG. 13 shows a fifth embodiment of a closure assembly in a closed configuration.
Figure 14:
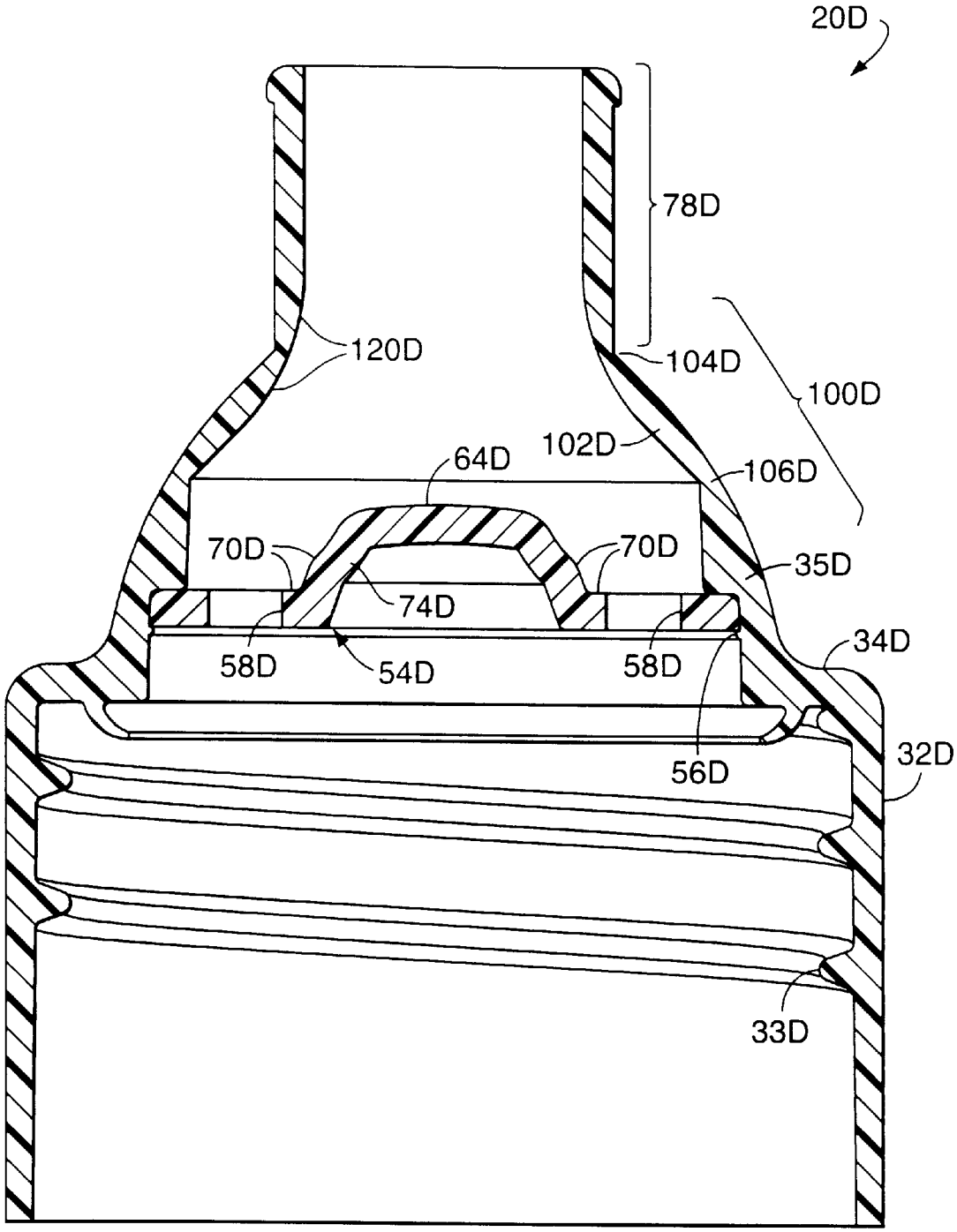
FIG. 14 is a cross-sectional view of the fifth embodiment of the closure assembly in an open configuration.

FIGS. 13 and 14 illustrate a fifth embodiment of the valve system of the present invention wherein the valve system is designated generally by the reference number 20D. The valve system 20D is in the form of a closure for the open end of a container, and includes a closure body having a skirt 32D, an inwardly extending annular shoulder or deck 34D at the top of the skirt 32D, and a neck 35D extending upwardly from the inner diameter of the shoulder 34D. The skirt 32D includes a thread 33D for engaging a thread on a container (not shown) to releasably attach the system to the container. Of course, other releasable or non-releasable attachment means may be provided. Further, in an alternate form (not illustrated), the closure body skirt 32D could extend as a unitary portion of a container so that the closure body would, in such a form, be considered a part of the container.

The skirt 32D, the shoulder 34D, and the neck 35D may together be characterized as defining a mounting portion for being fixed relative to the container (whether or not the skirt is releasably or non-releasably attached to the container and whether or not the skirt is formed as a unitary extension of the container). A spout 78D is connected to the mounting portion neck 35D through a resiliently deformable portion 100D (FIG. 14) which is preferably a toggle portion 100D that includes (a) a resiliently deformable, generally annular member 102D, (b) a first hinge region 104D between the generally annular member 102D and the spout 78D, and (c) a second hinge region 106D between the generally annular member 102D and the mounting portion neck 35D. The inside surface of the spout 78D, adjacent the first hinge region 104D, defines a seal surface 120D.

Extending across the inside of the structure, below the spout 78D, is a deck or wall portion 54D. In the preferred embodiment illustrated, the wall portion 54D is a separate element held in the closure neck 35D by a snap-fit bead 56D. The wall portion 54D defines at least one aperture 58D. In the preferred embodiment illustrated in FIGS. 13 and 14, there are three apertures 58D, and each aperture 58D is an arcuate slot having a locus which is a circular arc. The three circular arc slots or apertures 58D are arranged equidistantly and symmetrically about an axial centerline through the system.

The deck or wall portion 54D may be characterized as having an inlet side and an outlet side wherein the inlet faces downwardly toward the container and wherein the outlet side faces upwardly or outwardly from the container. Each of the apertures 58D extends from the inlet side to the outlet side of the wall portion 54D.

A central region of the wall portion 54D defines an upwardly extending projection 64D having peripheral, angled and curved portions 74D.

The outside surface of the deck or wall portion 54D may be characterized as defining a sealing surface or valve seat 70D for being sealingly engaged by the downwardly facing seal surface 120D of the spout 78D when the spout is in the closed configuration (FIG. 13). This prevents flow from the container through the spout.

The entire system 20D could be molded from a silicone material. Alternatively, the entire system could be molded from another suitable material, such as a thermoplastic elastomer, or other materials as described above with reference to the previously discussed embodiments.

The system 20D can be operated in the same manner as the other embodiments of the invention as discussed above with reference to FIGS. 1–12. The spout 78D is capable of being moved between a self-maintained open position (FIG. 14) and a self-maintained closed position (FIG. 13). The spout 78D can be pulled outwardly to the open position shown in FIG. 14 by the user pulling on the spout with the user's fingers or by the user pulling on the spout with the user's teeth. Also, the spout can be partially opened by pushing or pulling on the closed spout (FIG. 13) in a generally lateral direction to tilt or deform at least a portion of the spout so as to move part of the spout sealing surface 120D away from the valve seat 70D. The spout can also be partially opened by the user pulling the spout outwardly just a small amount and holding the spout in that position—an operation that would be facilitated if a travel stop (not illustrated) is permanently or temporarily employed. So long as the user maintains a sufficient force to disengage at least a portion of the confronting sealing surfaces, flow can occur through the partially opened configuration.

Depending upon the force required to move the spout 78D from the closed configuration (FIG. 13) to the open configuration (FIG. 14), it is possible in some applications to develop enough internal pressure by squeezing on the container so as to force the spout 78D to a partially open or full open configuration. However, where this is not desired, then the system 20D is designed to be sufficiently resistant to movement to a partial or full open configuration so that the movement of the spout to a partial or full open configuration will not occur during normal squeezing and pressurization of the container.

Figure 15:
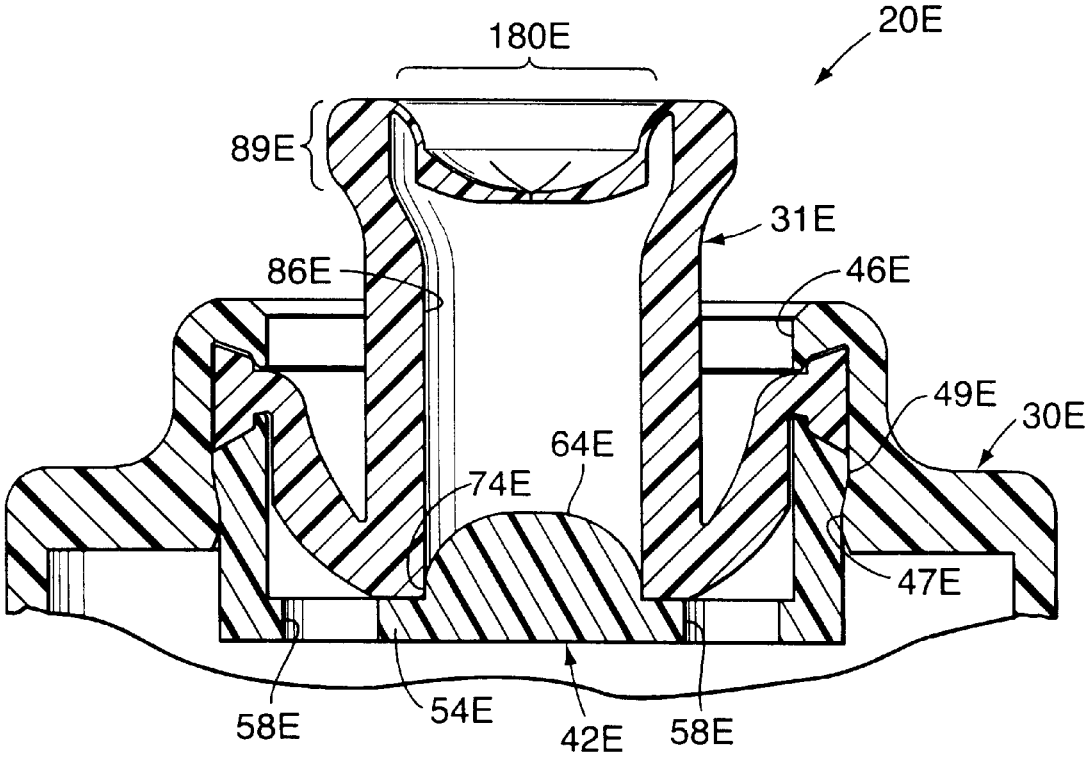
FIG. 15 is a fragmentary, cross-sectional view similar to FIG. 4, but FIG. 15 shows a sixth embodiment of a closure assembly in a closed configuration.

FIGS. 15–18 illustrates a sixth embodiment of the valve system of the present invention wherein the valve system is designated generally by the reference number 20E. As shown in FIG. 15, the valve system 20E includes a closure body 30E in which is mounted an inner retaining ring 42E. The body 30E and ring 42E together define a housing for holding a valve member 31E. In this embodiment, a separate outer retaining ring (such as the outer retaining ring 40 in the first embodiment shown in FIG. 4) has been omitted and replaced by an inwardly extending flange portion 46E of the closure body 30E.

Below the closure body flange 46E is an inwardly projecting retention bead 47E. The inner retaining ring 42E defines an annular bead 49E for being received in a snap-fit engagement over the bead 47E to compressively retain a peripheral portion of the valve member 31E against the flange 46E.

The inner retaining ring 42E includes a projection 64E which has a generally cylindrical, lower portion or surface 74E. The inner retaining ring 42E also includes a wall portion 54E with one or more apertures 58E radially outwardly of the central projection 64E.

The upper portion of the valve member 31E may be characterized as a spout portion or spout. The lower portion of the sixth embodiment valve member 31E is similar in shape to the lower portion of the valve member 31 described above with reference to the first embodiment illustrated in FIG. 4. The sixth embodiment valve member 31E differs somewhat, however, in that the upper portion or spout includes an increased diameter outlet region 89E at the distal end of a dispensing passage 86E across which is disposed a flexible, pressure-openable, slit valve 180E. The inner surface of the dispensing passage 86E below the outlet region 89E is generally cylindrical in the preferred configuration.

When the sixth embodiment valve member 31E is in the lowered, closed position (as illustrated in FIG. 15), the inner cylindrical surface of the valve member 31E is guided and received around, and is in an adjacent relationship with, the inner retaining ring cylindrical portion 74E as shown in FIG. 15. In the closed configuration, the lower end of the valve member 31E seals against the retaining ring wall portion 54E, and may also seal against the cylindrical portion 74E. The inner retaining ring apertures 58E are radially outwardly of the region which is sealed closed by the valve member 31E when the valve member 31E is in the closed configuration. The inner retaining ring 42E may be characterized as including (1) the wall portion 54E with inlet and outlet sides between which the apertures 58E extend, and (2) a valve seat on the outlet side against which the valve member 31E seals when the valve member 31E is in the closed configuration.

The sixth embodiment of the valve system of the present invention includes another novel feature in the form of the pressure-openable, flexible, slit-type dispensing valve 180E across the top of the valve member dispensing passage 86E. One such pressure-openable dispensing valve is described in the U.S. Pat. No. 6,062,435 wherein the valve is designated in FIG. 9 by reference number 80. The disclosures of U.S.

Pat. No. 6,062,435 are incorporated herein by reference thereto to the extent not inconsistent herewith.

The pressure-openable valve 180E functions as a "second" valve in addition to the primary toggle valve system of the present invention. The valve 180E is molded as a unitary part of the spout valve member 31E. Alternatively, such a pressure-openable slit valve could be a separately molded structure that is retained within the dispensing passage of the valve member 31E by suitable means, such as appropriate snap-fit engagements, adhesive bonding, etc. Such a pressure-openable slit valve could also be incorporated in the other embodiments of the system 20A, 20B, 20C, and 20D.

Below the pressure-openable valve 180E, the lower portion of the sixth embodiment valve member 31E operates in substantially the same way, as does the lower portion of the first embodiment valve member 31 described above.

Figure 16:
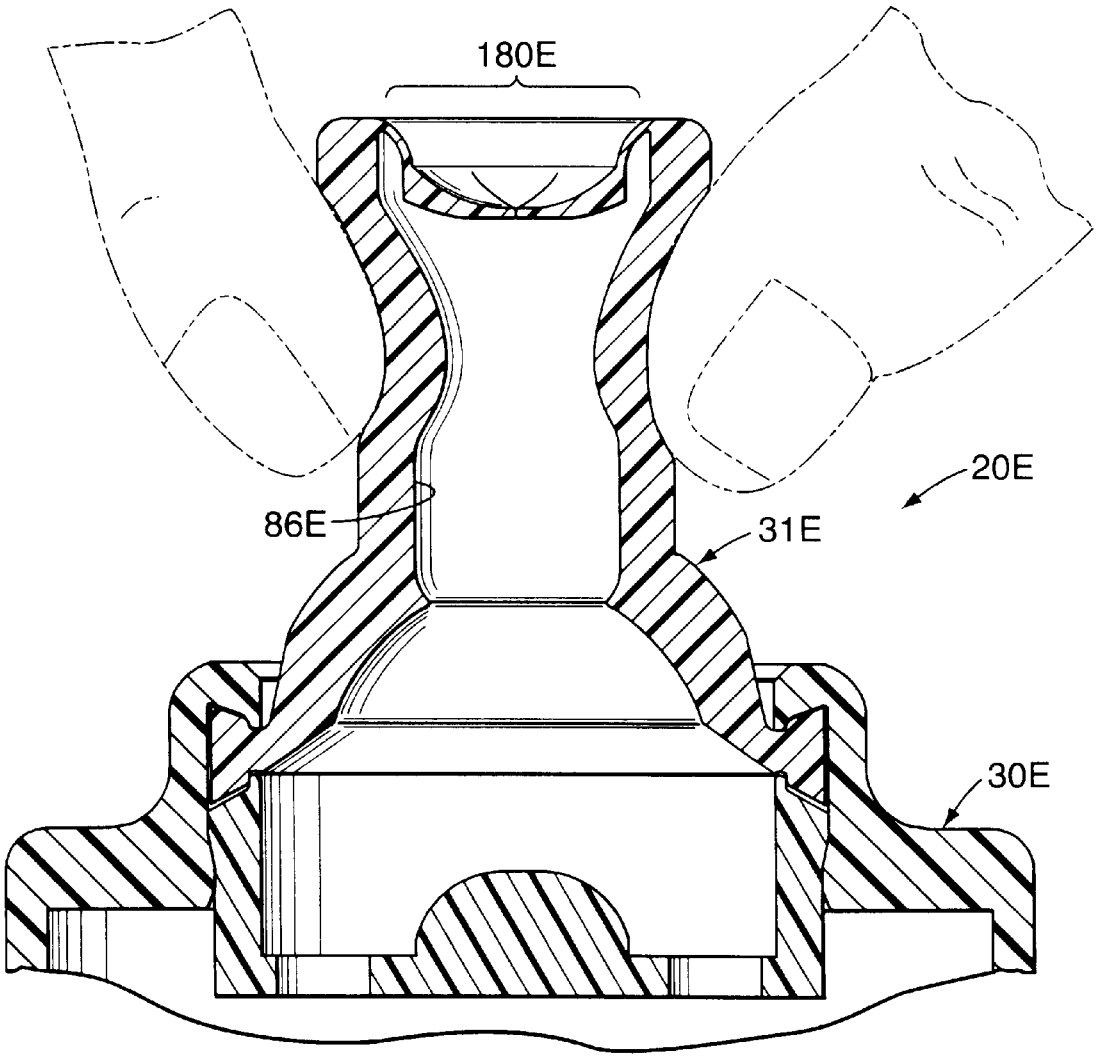
FIG. 16 is a view similar to FIG. 15, but FIG. 16 shows the closure assembly with its bistable valve member being pulled by the user to a self-maintained open position and wherein the valve member includes a spout having a flexible, pressure-openable, slit valve disposed in the spout across the dispensing passage in an initially closed condition.
Figure 17:
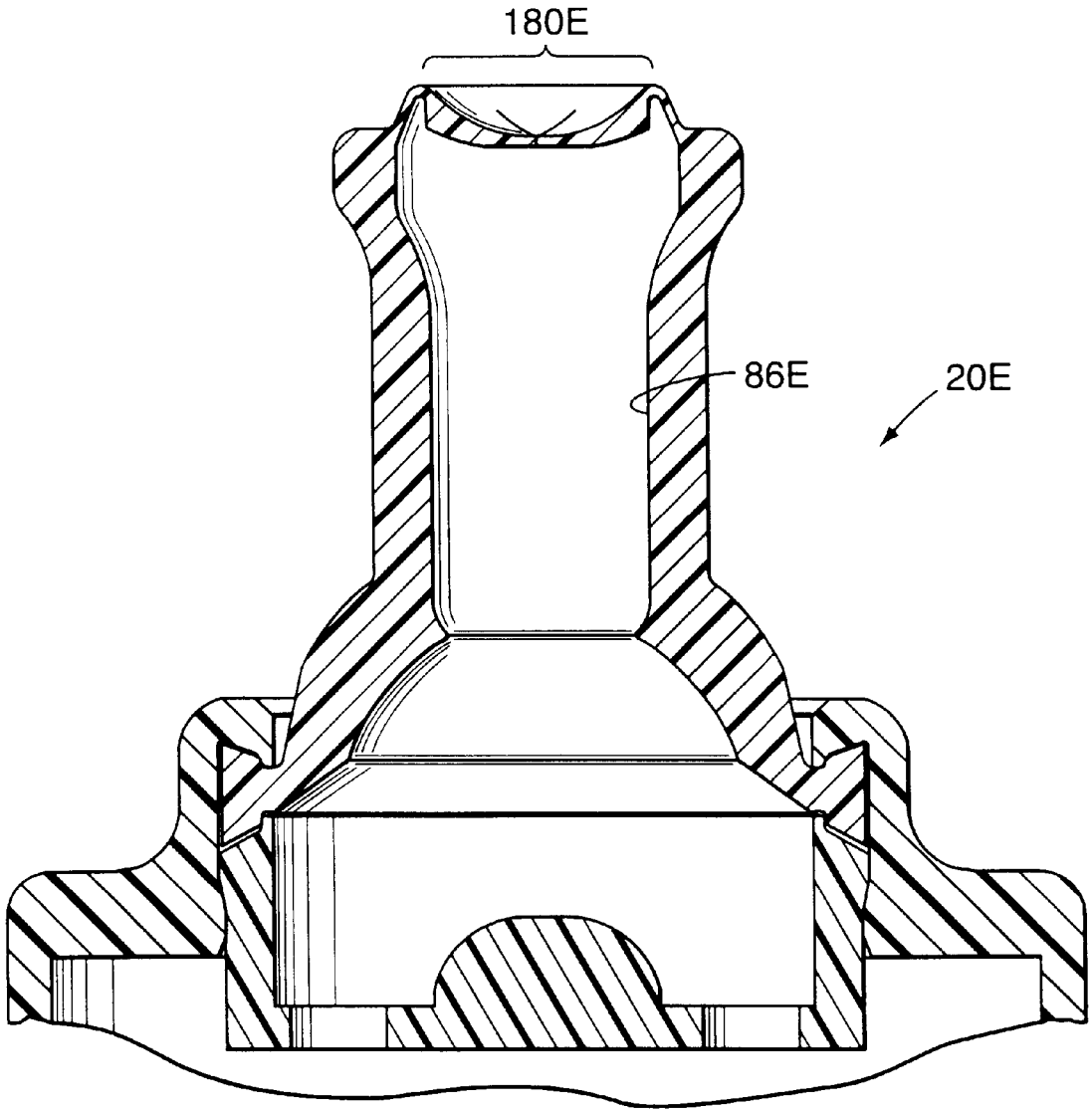
FIG. 17 is a view similar to FIG. 16, but FIG. 17 shows a pressure differential acting across the pressure-openable, slit valve to force the slit valve, while still closed, outwardly relative to the spout.

The valve system 20E can be opened by increasing the internal pressure in the container to which the valve system is attached or by pulling the valve member 31E upwardly (outwardly). FIG. 16 shows the sixth embodiment of the valve system being manipulated by a user to lift the valve member 31E to an upwardly or outwardly extended position. The user grasps the spout portion of the valve member 31E, typically between a thumb and index finger, and pulls the valve member 31E to the outwardly extended, self-maintained open position (FIGS. 16 and 17). If the container on which the valve system 20E is mounted is inadvertently tipped over, liquid does not flow out of the dispensing passage 86E because the pressure-openable valve 180E remains closed. Preferably, the valve 180E is designed to withstand the weight of the fluid on the inside of the valve 180E when the container is completely inverted. Preferably, the valve 180E is designed to open only after a sufficient amount of differential pressure acts across the valve 180E—as by the user sucking on the end of the valve member 31E and/or squeezing the container if the container is not a rigid container.

Figure 18:
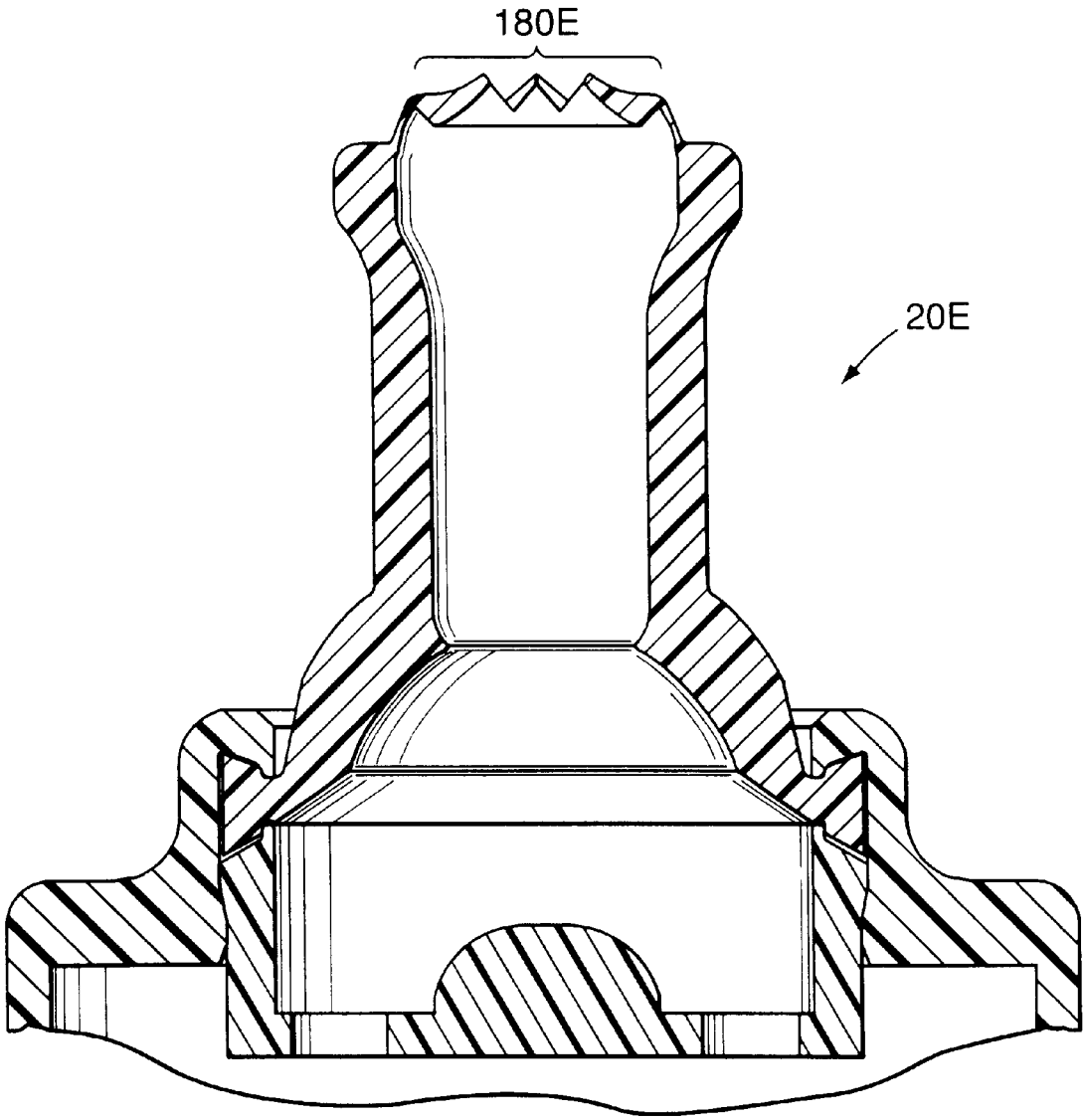
FIG. 18 is a view similar to FIG. 17, but FIG. 18 shows the pressure-openable, slit valve starting to open under the influence of a sufficient pressure differential acting across the slit valve.

When the valve member 31E is pulled out to the self-maintained open configuration as shown in FIG. 16, the valve 180E, in the preferred form illustrated, initially remains recessed relative to the top end of the valve member 31E. This provides some degree of protection for the valve 180E. However, when a person sucks on the end of the valve member 31E, and/or squeezes a flexible container on which the closure assembly 20E is mounted, then the pressure differential created across the valve 180E will cause the central portion of the valve member 180E to be forced outwardly from the recessed position to an outwardly moved position as shown in FIG. 17. Preferably, the valve 180E does not begin to open until the central portion of valve 180E has moved substantially all the way to the fully extended position shown in FIG. 17. Eventually, however, if the pressure differential across the valve 180E is sufficiently large, the valve 180E opens to dispense product. FIG. 18 illustrates the slits in the valve 180E beginning to open somewhat like petals of a flower.

If the differential pressure across the valve decreases sufficiently, the inherent resiliency of the valve 180E will cause it to close. The valve 180E will then assume the recessed position illustrated in FIG. 16. The user can optionally move the valve member 31E back to the self-maintained, fully closed position as illustrated in FIG. 15.

In the presently preferred form of the closure assembly illustrated in FIGS. 15–18, the valve member 31E, including the flexible, pressure-openable slit valve 180E, is molded as a unitary structure from material which is flexible, pliable, elastic, and resilient. This can include elastomers, such as a synthetic, thermosetting polymer, including silicone rubber, such as a silicone rubber sold by Dow Corning Corp. in the United States of America under the trade designation DC 94 595 HC. The valve member 31E, and the pressure-openable valve 180E molded unitary therewith, could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

Figure 19:
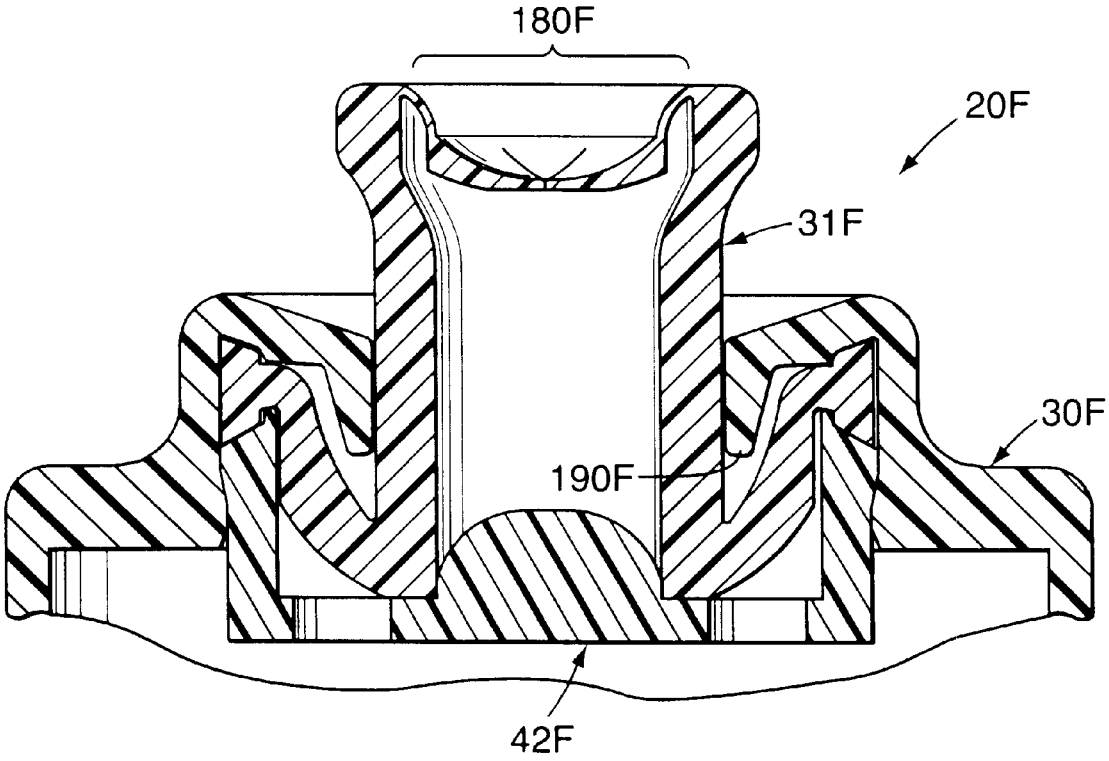
FIG. 19 is a view similar to FIG. 15, but FIG. 19 shows a seventh embodiment of the closure assembly in a closed configuration.
Figure 20:
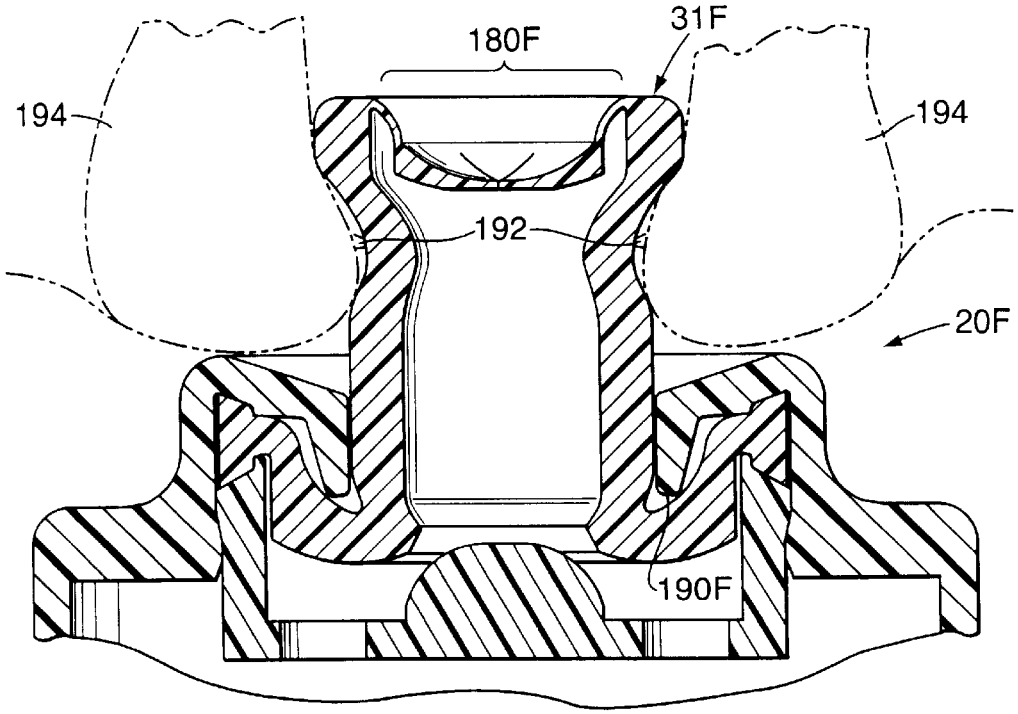
FIG. 20 is a view similar to FIG. 19, but FIG. 20 shows the user engaging a spout of the valve member of the closure assembly between the user's teeth and lips to lift the valve member to an open configuration while a flexible, pressure-openable, slit valve at the top of the valve member spout remains in a closed condition.
Figure 21:
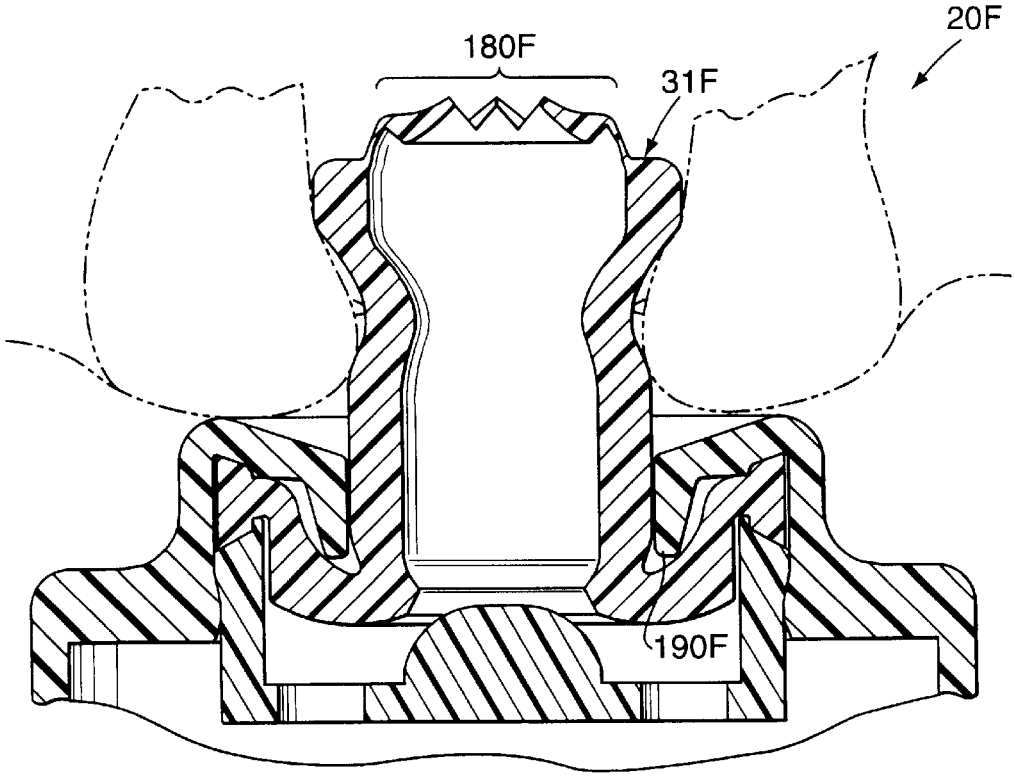
FIG. 21 is a view similar to FIG. 20, but FIG. 21 shows the pressure-openable, slit valve in an open condition as a result of a sufficient pressure differential acting across the slit valve.

FIGS. 19–21 illustrate a seventh embodiment of a closure assembly incorporating the valve system of the present invention. The seventh embodiment valve system is designated generally by the reference number 20F. As shown in FIG. 19, the valve system 20F includes a closure body 30F in which is mounted an inner retaining ring 42F. The body 30F and ring 42F together define a housing for holding a valve member 31F. The upper end of the valve member 31F includes a valve 180F. The components 30F, 31F, 42F, and 180F are substantially identical with the components 30E, 31E, 42E, and 180E, respectively, described above with reference to the sixth embodiment illustrated in FIGS. 15–18, except that in the seventh embodiment, the closure body 30F has an inwardly (downwardly) extending, annular abutment wall 190F. The annular abutment wall 190F significantly limits the outward movement of the valve member 31F between the fully closed position as shown in FIG. 19 and the upwardly moved, open position shown in FIGS. 20 and 21. The upwardly moved, open position illustrated in FIGS. 20 and 21 is not a self-maintained position because the annular wall 190F functions as a travel stop and prevents the valve member 31F from moving to and beyond the "overcenter toggle point" position of maximum stress (compare the seventh embodiment FIGS. 20 and 21 with the sixth embodiment of FIGS. 17 and 18). With the seventh embodiment, the user must continually maintain a pulling force on the valve member 34F to hold the valve member 31F away from the valve seat defined by the retaining ring 42F. The pulling force can be advantageously applied by the user directly with the user's teeth 192 and/or lips 194 (FIG. 20) engaging the valve member 31F.

The valve 180F at the top of the valve member 31F can be opened by squeezing on the container (if the container is not rigid), and/or by sucking on the valve member 31F so as to create a pressure differential across the valve 180F which will be of sufficient magnitude to cause the valve 180F to open as shown in FIG. 21.

The advantage of the seventh embodiment illustrated in FIGS. 19–21 is that the user can operate the system in a "hands-free" mode. The user need not manipulate the system with the user's fingers. Rather, the user can open the main seal at the bottom of the valve member 31F merely by pulling the valve member 31F upwardly with the user's mouth, and then the user can open the secondary valve (the slit valve 180F) by merely creating a suction. The valve system is self-closing when the user's mouth is sufficiently disengaged with the valve member 31F to permit the valve member 31F to return to the normal, self-biased, fully closed condition (FIG. 19).

The seventh embodiment of the invention illustrated in FIGS. 19–21 allows the user to readily open the system for dispensing with the user's mouth, and the user need only hold the container with one hand during this process. That permits the user to have one hand free for other activities. This is especially advantageous if the user is dispensing fluids during a sporting event, such as bicycle racing.

It will be appreciated that the sixth and seventh embodiments illustrated in FIGS. 15–18, and 19–21, respectively, allow the primary (lower) valve to be open while still providing the user with flow control and the ability to invert the system and yet have protection from undesired dispensing (owing to the protective function provided by the secondary, pressure-openable, slit valve).

Owing to the use of the primary valve sealing against the retaining ring at the bottom of the valve member, there is a good seal which insures safe storage and eliminates, or at least minimizes, the chance of undesired dispensing.

The secondary valve (i.e., the pressure-openable slit valve) allows the primary valve (the valve at the bottom of the valve member) to be open while still giving the user a significant amount of control over dispensing by controlling the flow rate and opening pressure. In the closed condition, the secondary valve (i.e., the pressure-openable slit valve) defines a barrier against contaminant ingress and maintains package integrity so as to provide a sanitary product.

It will also be appreciated that the system of the sixth and seventh embodiments illustrated in FIGS. 15–21 could be made from a combination of materials. Further, components could be connected together by swaging and/or by injection molding. The valve systems of this invention could also be molded as a single, unitary structure. In this respect, the term "closure assembly" used in this specification and in the claims should be construed to include a valve system of this invention that is a single unitary structure as well as a valve system that comprises two or more separate components. Further, the closure assembly could be formed as a unitary part, or extension of, a container.

It will be readily observed from the foregoing detailed description of the invention and from the illustrations thereof that numerous other variations and modifications may be effected without departing from the true spirit and scope of the novel concepts or principles of this invention.

What is claimed is:

1. A valve system comprising:

(A) a wall portion that can be incorporated on a container of fluent material and that includes
  (1) an inlet side and an outlet side,
  (2) at least one aperture extending between said inlet and outlet sides, and
  (3) a valve seat on said outlet side; and (B) a valve member that includes
  (1) a spout that defines a dispensing passage terminating in a dispensing orifice;
  (2) a mounting portion for mounting said valve member adjacent said wall portion, said mounting portion being fixed relative to said wall portion;
  (3) a resiliently deformable portion extending between said mounting portion and said spout to accommodate movement of said valve member from a self-maintained closed position to at least a partly open position; and
  (4) at least one seal surface recessed inwardly from said spout dispensing orifice for sealingly engaging said wall portion valve seat when said valve member is in said closed position to prevent flow from said wall portion aperture through said spout dispensing passage; and
  wherein
    (i) said valve member is molded from silicone;
    (ii) said resiliently deformable portion is a toggle portion extending between said mounting portion and said spout for holding said valve member in either said self-maintained closed position or a self-maintained open position, and wherein said toggle portion includes (a) a resiliently deformable region, (b) a first hinge region between said deformable region and said spout, and (c) a second hinge region between said deformable region and said mounting portion so that, as said valve member is moved between said closed and open positions, said first and second hinge regions accommodate resilient deformation of said deformable region through an unstable condition of maximum stress between initial and final stable conditions of lower stress;
    (iii) at least part of said resiliently deformable region is thicker than each of said first and second hinge regions;
    (iv) said second hinge region is located outwardly of said first hinge region in the flow-dispensing direction of said spout when said valve member is in the closed position;
    (v) said first hinge region is located outwardly of said second hinge region in the flow-dispensing direction of said spout when said valve member is in the open position,
    (vi) said spout, mounting portion, and resiliently deformable portion together define a single unitary construction; and
    (vii) said second hinge region is defined by a reduced thickness region that is unitary with, and extends between, said mounting portion and said resiliently deformable region.

2. The valve system in accordance with claim 1 in which (1) said wall portion includes a generally annular deck defining (a) said inlet and outlet sides, and (b) said valve seat on said outlet side;

(2) said at least one aperture is an arcuate slot located radially outwardly of said valve seat in said annular deck; and (3) said valve member seal surface is defined by an inner circumferential surface on said deformable portion adjacent said spout.

3. The valve system in accordance with claim 1 in which said valve member is molded as a unitary structure that includes (1) said spout;

(2) said mounting portion;

(3) said resiliently deformable portion; and (4) said at least one seal surface.

4. The valve system in accordance with claim 3 in which said mounting portion is a skirt for being releasably attached to a container.

5. The valve system in accordance with claim 1 in which at least said spout of said valve member is molded from silicone and is adapted for being held either between a user's teeth or a user's finger and thumb to allow the user to pull on said spout to move said valve member from said closed position to said self-maintained open position.

6. The valve system in accordance with claim 1 in which said valve member has an interior surface portion in communication with said aperture when said valve member is in said closed position whereby sufficient pressurization of said fluent material against said interior surface portion can force said valve member from said closed position to said open position.

7. The valve system in accordance with claim 1 in which said valve system is part of a closure system that (1) is adapted for use on a container having an opening to the container interior;

(2) has a housing that includes a skirt for mounting said housing on said container at said opening; and (3) said valve member is separate from said housing but is retained in said housing over said opening.

8. The valve system in accordance with claim 1 in which said valve member mounting portion is an annular mounting flange; and said wall portion includes (1) an annular collar for engaging said mounting flange;

(2) a central projection for extending into a portion of said spout dispensing passage; and (3) a deck that (a) extends radially between said central projection and said collar, (b) defines said inlet and outlet sides of said wall portion, and (c) defines said at least one aperture.

* * * * *